US007618497B2

(12) United States Patent
Kato et al.

(10) Patent No.: US 7,618,497 B2
(45) Date of Patent: Nov. 17, 2009

(54) R-T-B BASED RARE EARTH PERMANENT MAGNET AND METHOD FOR PRODUCTION THEREOF

(75) Inventors: Eiji Kato, Tokyo (JP); Chikara Ishizaka, Tokyo (JP)

(73) Assignee: TDK Corporation, Tokyo (JP)

( * ) Notice: Subject to any disclaimer, the term of this patent is extended or adjusted under 35 U.S.C. 154(b) by 487 days.

(21) Appl. No.: 10/541,964

(22) PCT Filed: Jun. 24, 2004

(86) PCT No.: PCT/JP2004/009501

§ 371 (c)(1),
(2), (4) Date: Apr. 7, 2006

(87) PCT Pub. No.: WO2005/001856

PCT Pub. Date: Jan. 6, 2005

(65) Prior Publication Data

US 2006/0231165 A1 Oct. 19, 2006

(30) Foreign Application Priority Data

Jun. 30, 2003 (JP) ..... 2003-188534

(51) Int. Cl.
*H01F 1/057* (2006.01)

(52) U.S. Cl. ..... 148/302; 75/244; 419/12

(58) Field of Classification Search ..... None
See application file for complete search history.

(56) References Cited

U.S. PATENT DOCUMENTS

2004/0020563 A1* 2/2004 Tokuhara et al. ..... 148/105
2005/0098238 A1* 5/2005 Morimoto et al. ..... 148/302

FOREIGN PATENT DOCUMENTS

| | | |
|---|---|---|
| CN | 1114779 | 1/1996 |
| CN | 20048000690.5 | 6/2004 |
| JP | 60-032306 | 2/1985 |
| JP | 63-093841 | 4/1988 |
| JP | 05-021218 | 1/1993 |
| JP | 07-057913 | 3/1995 |
| JP | 07-122413 | 5/1995 |
| JP | 09-232173 | 9/1997 |
| JP | 2000-188213 | 7/2000 |
| JP | 2002-299110 | 10/2002 |

* cited by examiner

*Primary Examiner*—John P. Sheehan
(74) *Attorney, Agent, or Firm*—Hogan & Hartson LLP

(57) ABSTRACT

An R-T-B system rare earth permanent magnet, which comprises main phase grains consisting of $R_2T_{14}B$ compounds and a grain boundary phase having a higher amount of R than the above described main phase grains, and which satisfies AVE(X)/Y=0.8 to 1.0; and (X/Y)max/(X/Y)min=2.0 to 13.0, wherein X represents (weight ratio of heavy rare earth elements)/(the weight ratio of all rare earth elements) for a given number of the above described main phase grains Y represents (weight ratio of heavy rare earth elements)/(weight ratio of all rare earth elements) for the sintered body as a whole; AVE(X) represents the mean value of X obtained for the given number of main phase grains; (X/Y)min represents the minimum value of (X/Y) obtained for the given number of main phase grains; and (X/Y)max represents the maximum value of (X/Y) obtained for the given number of main phase grains.

9 Claims, 31 Drawing Sheets

| | AVE(X) | Y | AVE(X)/Y | (X/Y)min | (X/Y)max | (X/Y)max/(X/Y)min |
|---|---|---|---|---|---|---|
| EXAMPLE 1 | 7.58 | 9.01 | 0.84 | 0.12 | 1.43 | 11.92 |
| EXAMPLE 2 | 8.08 | 8.88 | 0.91 | 0.15 | 1.33 | 8.87 |
| COMPARATIVE EXAMPLE 1 | 10.14 | 9.14 | 1.11 | 1.01 | 1.25 | 1.24 |
| COMPARATIVE EXAMPLE 2 | 10.21 | 8.80 | 1.16 | 1.05 | 1.27 | 1.21 |

FIG. 1

| | | Nd (wt%) | Pr (wt%) | Dy (wt%) | TOTAL R (wt%) | B (wt%) | Al (wt%) | Co (wt%) | Cu (wt%) | Fe (wt%) | MIXTURE RATIO | REMARKS |
|---|---|---|---|---|---|---|---|---|---|---|---|---|
| EXAMPLE 1 | LOW R ALLOY | 26.4 | 5.5 | – | 31.9 | 1.06 | 0.2 | — | – | bal. | 95 | HEAVY RARE EARTH ELEMENT (Dy) CONTAINED IN HIGH R ALLOY |
| | HIGH R ALLOY | – | – | 60.2 | 60.2 | – | 0.2 | 10.2 | 1.4 | bal. | 5 | |
| EXAMPLE 2 | LOW R ALLOY | 25.3 | 5.7 | – | 31.0 | 1.12 | 0.2 | – | – | bal. | 90 | HEAVY RARE EARTH ELEMENT (Dy) CONTAINED IN HIGH R ALLOY |
| | HIGH R ALLOY | 29.2 | 0.1 | 30.3 | 59.6 | – | 0.2 | 5.0 | 0.7 | bal. | 10 | |
| COMPARATIVE EXAMPLE 1 | LOW R ALLOY | 22.0 | 5.8 | 3.4 | 31.2 | 1.12 | 0.2 | – | – | bal. | 90 | HEAVY RARE EARTH ELEMENT (Dy) CONTAINED IN LOW R ALLOY |
| | HIGH R ALLOY | 29.0 | 0.2 | – | 29.2 | – | 0.2 | 5.0 | 0.7 | bal. | 10 | |
| COMPARATIVE EXAMPLE 2 | LOW R ALLOY | 24.1 | 5.5 | 3.2 | 32.8 | 1.06 | 0.2 | – | – | bal. | 95 | HEAVY RARE EARTH ELEMENT (Dy) CONTAINED IN LOW R ALLOY |
| | HIGH R ALLOY | 59.6 | 0.2 | – | 59.8 | – | 0.2 | 10.2 | 1.4 | bal. | 5 | |

FIG. 2

| | Nd (wt%) | Pr (wt%) | Dy (wt%) | TOTAL R (wt%) | B (wt%) | Al (wt%) | Co (wt%) | Cu (wt%) | Fe (wt%) | Br (kG) | HcJ (kOe) |
|---|---|---|---|---|---|---|---|---|---|---|---|
| EXAMPLE 1 | 25.1 | 5.2 | 3.0 | 33.3 | 1.0 | 0.2 | 0.5 | 0.1 | bal. | 12.90 | 23.09 |
| EXAMPLE 2 | 25.7 | 5.1 | 3.0 | 33.8 | 1.0 | 0.2 | 0.5 | 0.1 | bal. | 12.78 | 23.12 |
| COMPARATIVE EXAMPLE 1 | 25.6 | 5.2 | 3.1 | 33.9 | 1.0 | 0.2 | 0.5 | 0.1 | bal. | 12.51 | 23.18 |
| COMPARATIVE EXAMPLE 2 | 25.9 | 5.2 | 3.0 | 34.1 | 1.0 | 0.2 | 0.5 | 0.1 | bal. | 12.50 | 23.17 |

FIG. 5

| | AVE(X) | Y | AVE(X)／Y | (X／Y)min | (X／Y)max | (X／Y)max／(X／Y)min |
|---|---|---|---|---|---|---|
| EXAMPLE 1 | 7.58 | 9.01 | 0.84 | 0.12 | 1.43 | 11.92 |
| EXAMPLE 2 | 8.08 | 8.88 | 0.91 | 0.15 | 1.33 | 8.87 |
| COMPARATIVE EXAMPLE 1 | 10.14 | 9.14 | 1.11 | 1.01 | 1.25 | 1.24 |
| COMPARATIVE EXAMPLE 2 | 10.21 | 8.80 | 1.16 | 1.05 | 1.27 | 1.21 |

FIG. 6

| | Nd (wt%) | Pr (wt%) | Dy (wt%) | TOTAL R (wt%) | B (wt%) | Al (wt%) | Co (wt%) | Cu (wt%) | Fe (wt%) | Br (kG) | HcJ (kOe) |
|---|---|---|---|---|---|---|---|---|---|---|---|
| EXAMPLE 1 | 25.1 | 5.2 | 3.0 | 33.3 | 1.0 | 0.2 | 0.5 | 0.1 | bal. | 12.90 | 23.09 |
| EXAMPLE 3 | 25.0 | 5.2 | 3.0 | 33.2 | 1.0 | 0.2 | 0.5 | 0.1 | bal. | 12.91 | 22.83 |
| EXAMPLE 4 | 25.4 | 5.1 | 3.1 | 33.6 | 1.0 | 0.2 | 0.5 | 0.1 | bal. | 12.89 | 22.22 |
| EXAMPLE 5 | 25.1 | 5.2 | 3.1 | 33.4 | 1.0 | 0.2 | 0.5 | 0.1 | bal. | 13.04 | 21.14 |

FIG. 7

| | AVE(X) | Y | AVE(X)／Y | (X／Y)min | (X／Y)max | (X／Y)max／(X／Y)min |
|---|---|---|---|---|---|---|
| EXAMPLE 1 | 7.58 | 9.01 | 0.84 | 0.12 | 1.43 | 11.92 |
| EXAMPLE 3 | 7.50 | 9.04 | 0.83 | 0.22 | 1.32 | 6.00 |
| EXAMPLE 4 | 7.87 | 9.22 | 0.86 | 0.18 | 1.37 | 7.61 |
| EXAMPLE 5 | 8.35 | 9.27 | 0.89 | 0.16 | 1.53 | 9.56 |

FIG. 12

| | | Nd (wt%) | Pr (wt%) | Dy (wt%) | TOTAL R (wt%) | B (wt%) | Al (wt%) | Co (wt%) | Cu (wt%) | Fe (wt%) | MIXTURE RATIO | REMARKS |
|---|---|---|---|---|---|---|---|---|---|---|---|---|
| EXAMPLE 6 | LOW R ALLOY | 27.5 | – | 4.1 | 31.6 | 1.06 | 0.2 | — | – | bal. | 95 | HEAVY RARE EARTH ELEMENT (Dy) CONTAINED IN HIGH R ALLOY AND IN LOW R ALLOY |
| | HIGH R ALLOY | – | – | 46.0 | 46.0 | – | 0.2 | 10.0 | 2.0 | bal. | 5 | |
| EXAMPLE 7 | LOW R ALLOY | 29.4 | – | 2.2 | 31.6 | 1.06 | 0.2 | – | – | bal. | 95 | HEAVY RARE EARTH ELEMENT (Dy) CONTAINED IN HIGH R ALLOY AND IN LOW R ALLOY |
| | HIGH R ALLOY | – | – | 46.0 | 46.0 | – | 0.2 | 10.0 | 2.0 | bal. | 5 | |
| COMPARATIVE EXAMPLE 3 | LOW R ALLOY | 22.4 | – | 7.1 | 29.5 | 1.12 | 0.2 | – | – | bal. | 90 | HEAVY RARE EARTH ELEMENT (Dy) CONTAINED IN LOW R ALLOY |
| | HIGH R ALLOY | 59.0 | – | – | 59.0 | – | 0.2 | 5.0 | 1.0 | bal. | 10 | |
| COMPARATIVE EXAMPLE 4 | LOW R ALLOY | 25.0 | – | 4.0 | 29.0 | 1.28 | 0.2 | – | – | bal. | 80 | HEAVY RARE EARTH ELEMENT (Dy) CONTAINED IN HIGH R ALLOY AND IN LOW R ALLOY |
| | HIGH R ALLOY | 33.5 | 6.0 | 6.5 | 46.0 | – | 0.2 | 2.5 | 0.5 | bal. | 20 | |

FIG. 13

| | Nd (wt%) | Pr (wt%) | Dy (wt%) | TOTAL R (wt%) | B (wt%) | Al (wt%) | Co (wt%) | Cu (wt%) | Fe (wt%) | Br (kG) | HcJ (kOe) |
|---|---|---|---|---|---|---|---|---|---|---|---|
| EXAMPLE 6 | 26.0 | – | 6.2 | 32.2 | 1.0 | 0.2 | 0.5 | 0.1 | bal. | 12.60 | 25.00 |
| EXAMPLE 7 | 27.8 | – | 4.4 | 32.2 | 1.0 | 0.2 | 0.5 | 0.1 | bal. | 13.00 | 23.62 |
| COMPARATIVE EXAMPLE 3 | 25.9 | – | 6.3 | 32.2 | 1.0 | 0.2 | 0.5 | 0.1 | bal. | 12.31 | 25.00 |
| COMPARATIVE EXAMPLE 4 | 26.6 | 1.2 | 4.5 | 32.3 | 1.0 | 0.2 | 0.5 | 0.1 | bal. | 12.60 | 23.60 |

FIG. 16

| | AVE(X) | Y | AVE(X)／Y | (X／Y)min | (X／Y)max | (X／Y)max／(X／Y)min |
|---|---|---|---|---|---|---|
| EXAMPLE 6 | 16.54 | 19.25 | 0.85 | 0.40 | 1.04 | 2.60 |
| EXAMPLE 7 | 13.14 | 13.66 | 0.96 | 0.51 | 1.12 | 2.20 |
| COMPARATIVE EXAMPLE 3 | 20.74 | 19.57 | 1.06 | 0.88 | 1.31 | 1.49 |
| COMPARATIVE EXAMPLE 4 | 15.70 | 14.98 | 1.05 | 0.73 | 1.33 | 1.82 |

FIG. 17

| | S50 (μm) | S85 (μm) | <10μm (%) | <15μm (%) |
|---|---|---|---|---|
| EXAMPLE 6 | 8.29 | 12.1 | 64.6 | 100 |
| EXAMPLE 7 | 9.90 | 14.6 | 50.4 | 88.1 |
| COMPARATIVE EXAMPLE 3 | 10.37 | 17.4 | 24.6 | 69.0 |
| COMPARATIVE EXAMPLE 4 | 12.48 | 16.3 | 32.1 | 75.1 |

FIG. 18

| | | Nd (wt%) | Pr (wt%) | Dy (wt%) | TOTAL R (wt%) | B (wt%) | Al (wt%) | Co (wt%) | Cu (wt%) | Fe (wt%) | MIXTURE RATIO | REMARKS |
|---|---|---|---|---|---|---|---|---|---|---|---|---|
| EXAMPLE 8 | LOW R ALLOY | 26.9 | 5.6 | – | 32.5 | 1.06 | 0.2 | — | – | bal. | 75 | HEAVY RARE EARTH ELEMENT (Dy) CONTAINED IN HIGH R ALLOY |
| | LOW R ALLOY | 29.9 | 5.6 | – | 0.0 | 1.06 | 0.2 | – | – | bal. | 20 | |
| | HIGH R ALLOY | – | – | 60.0 | 60.0 | – | 0.2 | 10.0 | 1.4 | bal. | 5 | |
| COMPARATIVE EXAMPLE 5 | LOW R ALLOY | 26.3 | 5.7 | – | 32.0 | 1.12 | 0.2 | – | – | bal. | 60 | HEAVY RARE EARTH ELEMENT (Dy) CONTAINED IN HIGH R ALLOY AT 30% OR LESS BY WEIGHT |
| | LOW R ALLOY | 19.6 | 5.4 | 7.5 | 32.5 | 1.06 | 0.2 | – | – | bal. | 31 | |
| | HIGH R ALLOY | 60.0 | – | – | 60.0 | – | 0.2 | 5.0 | 0.7 | bal. | 7 | |
| | HIGH R ALLOY | 16.0 | – | 44.0 | 60.0 | – | 0.2 | 10.0 | 1.4 | bal. | 2 | |
| COMPARATIVE EXAMPLE 6 | LOW R ALLOY | 26.3 | 5.7 | – | 32.0 | 1.12 | 0.2 | – | – | bal. | 60 | HEAVY RARE EARTH ELEMENT (Dy) CONTAINED IN LOW R ALLOY |
| | LOW R ALLOY | 17.5 | 5.4 | 9.7 | 32.6 | 1.06 | 0.2 | – | – | bal. | 31 | |
| | HIGH R ALLOY | 60.0 | – | – | 60.0 | – | 0.2 | 5.0 | 0.7 | bal. | 7 | |
| | HIGH R ALLOY | 60.0 | – | – | 60.0 | – | 0.2 | 10.0 | 1.4 | bal. | 2 | |

FIG. 19

| | Nd (wt%) | Pr (wt%) | Dy (wt%) | TOTAL R (wt%) | B (wt%) | Al (wt%) | Co (wt%) | Cu (wt%) | Fe (wt%) | Br (kG) | HcJ (kOe) |
|---|---|---|---|---|---|---|---|---|---|---|---|
| EXAMPLE 8 | 26.2 | 5.3 | 3.0 | 34.5 | 1.0 | 0.2 | 0.5 | 0.1 | bal. | 12.68 | 23.68 |
| COMPARATIVE EXAMPLE 5 | 26.2 | 5.1 | 3.2 | 34.5 | 1.0 | 0.2 | 0.5 | 0.1 | bal. | 12.65 | 22.60 |
| COMPARATIVE EXAMPLE 6 | 26.3 | 5.1 | 3.0 | 34.4 | 1.0 | 0.2 | 0.5 | 0.1 | bal. | 12.66 | 22.44 |

FIG. 22

| | AVE(X) | Y | AVE(X)／Y | (X／Y)min | (X／Y)max | (X／Y)max／(X／Y)min |
|---|---|---|---|---|---|---|
| EXAMPLE 8 | 7.40 | 8.70 | 0.85 | 0.20 | 1.31 | 6.55 |
| COMPARATIVE EXAMPLE 5 | 9.70 | 8.75 | 1.11 | 0.21 | 2.43 | 11.57 |
| COMPARATIVE EXAMPLE 6 | 8.25 | 8.72 | 0.95 | 0.16 | 2.60 | 16.25 |

FIG. 25

| | | Nd (wt%) | Tb (wt%) | TOTAL R (wt%) | B (wt%) | Al (wt%) | Co (wt%) | Cu (wt%) | Fe (wt%) | (MIXTURE RATIO) |
|---|---|---|---|---|---|---|---|---|---|---|
| EXAMPLE 9 | LOW R ALLOY | 30.3 | – | 30.30 | 1.06 | 0.2 | – | – | bal. | 70 |
| | LOW R ALLOY | 24.6 | 5.7 | 30.30 | 1.06 | 0.2 | – | – | bal. | 25 |
| | HIGH R ALLOY | – | 46.0 | 46.00 | – | 0.2 | 10.0 | 2.0 | bal. | 5 |
| EXAMPLE10 | LOW R ALLOY | 30.3 | – | 30.30 | 1.06 | 0.2 | – | – | bal. | 60 |
| | LOW R ALLOY | 26.3 | 4.0 | 30.30 | 1.06 | 0.2 | – | – | bal. | 35 |
| | HIGH R ALLOY | – | 46.0 | 46.00 | – | 0.2 | 10.0 | 2.0 | bal. | 5 |
| COMPARATIVE EXAMPLE 7 | LOW R ALLOY | 26.4 | 3.9 | 30.30 | 1.06 | 0.2 | – | – | bal. | 95 |
| | HIGH R ALLOY | 46.0 | – | 46.00 | – | 0.2 | 10.0 | 2.0 | bal. | 5 |
| COMPARATIVE EXAMPLE 8 | LOW R ALLOY | 27.1 | 3.1 | 30.20 | 1.06 | 0.2 | – | – | bal. | 55 |
| | LOW R ALLOY | 25.3 | 5.0 | 30.30 | 1.06 | 0.2 | – | – | bal. | 40 |
| | HIGH R ALLOY | 46.0 | – | 46.00 | – | 0.2 | 10.0 | 2.0 | bal. | 5 |

FIG. 26

| | Nd (wt%) | Tb (wt%) | TOTAL R (wt%) | B (wt%) | Al (wt%) | Co (wt%) | Cu (wt%) | Fe (wt%) | Br (kG) | HcJ (kOe) |
|---|---|---|---|---|---|---|---|---|---|---|
| EXAMPLE 9 | 27.3 | 3.7 | 31.0 | 1.0 | 0.2 | 0.5 | 0.1 | bal. | 13.45 | 24.1 |
| EXAMPLE 10 | 27.3 | 3.7 | 31.0 | 1.0 | 0.2 | 0.5 | 0.1 | bal. | 13.43 | 24.2 |
| COMPARATIVE EXAMPLE 7 | 27.3 | 3.7 | 31.0 | 1.0 | 0.2 | 0.5 | 0.1 | bal. | 13.19 | 24.4 |
| COMPARATIVE EXAMPLE 8 | 27.3 | 3.7 | 31.0 | 1.0 | 0.2 | 0.5 | 0.1 | bal. | 13.20 | 24.7 |

FIG. 27

| | AVE(X) | Y | AVE(X)／Y | (X／Y)min | (X／Y)max | (X／Y)max／(X／Y)min |
|---|---|---|---|---|---|---|
| EXAMPLE 9 | 10.47 | 11.90 | 0.88 | 0.21 | 1.23 | 5.86 |
| EXAMPLE 10 | 11.18 | 11.90 | 0.94 | 0.56 | 1.54 | 2.75 |
| COMPARATIVE EXAMPLE 7 | 14.52 | 11.90 | 1.22 | 0.95 | 1.42 | 1.49 |
| COMPARATIVE EXAMPLE 8 | 15.59 | 11.90 | 1.31 | 1.04 | 1.37 | 1.32 |

FIG. 28

| | S50 (μm) | S85 (μm) | <10μm (%) | <15μm (%) |
|---|---|---|---|---|
| EXAMPLE 9 | 7.67 | 10.96 | 75.3 | 100 |
| EXAMPLE 10 | 4.49 | 8.51 | 90.2 | 98.9 |
| COMPARATIVE EXAMPLE 7 | 4.17 | 5.85 | 100 | 100 |
| COMPARATIVE EXAMPLE 8 | 5.08 | 6.90 | 100 | 100 |

FIG. 29

| | | Nd (wt%) | Dy (wt%) | TOTAL R (wt%) | B (wt%) | Al (wt%) | Co (wt%) | Cu (wt%) | Fe (wt%) | (MIXTURE RATIO) |
|---|---|---|---|---|---|---|---|---|---|---|
| EXAMPLE11 | LOW R ALLOY | 27.4 | – | 27.40 | 1.06 | 0.3 | – | – | bal. | 95 |
| | HIGH R ALLOY | – | 40.0 | 40.00 | – | 0.3 | 10.0 | 2.0 | bal. | 5 |
| EXAMPLE12 | LOW R ALLOY | 34.7 | – | 34.70 | 1.06 | 0.2 | – | – | bal. | 95 |
| | HIGH R ALLOY | – | 60.0 | 60.00 | – | 0.2 | 30.0 | 2.8 | bal. | 5 |
| COMPARATIVE EXAMPLE 9 | LOW R ALLOY | 25.3 | 2.1 | 27.40 | 1.06 | 0.2 | – | – | bal. | 95 |
| | HIGH R ALLOY | 40.0 | – | 40.00 | – | 0.2 | 10.0 | 2.0 | bal. | 5 |
| COMPARATIVE EXAMPLE 10 | LOW R ALLOY | 31.5 | 3.2 | 34.70 | 1.06 | 0.2 | – | – | bal. | 95 |
| | HIGH R ALLOY | 60.0 | – | 60.00 | – | 0.2 | 30.0 | 2.8 | bal. | 5 |

FIG. 30

| | Nd (wt%) | Dy (wt%) | TOTAL R (wt%) | B (wt%) | Al (wt%) | Co (wt%) | Cu (wt%) | Fe (wt%) | Br (kG) | HcJ (kOe) |
|---|---|---|---|---|---|---|---|---|---|---|
| EXAMPLE11 | 26.0 | 2.0 | 28.0 | 1.0 | 0.3 | 0.5 | 0.1 | bal. | 14.2 | 12.2 |
| EXAMPLE12 | 33.0 | 3.0 | 36.0 | 1.0 | 0.2 | 1.5 | 0.14 | bal. | 12.1 | 25.3 |
| COMPARATIVE EXAMPLE 9 | 26.0 | 2.0 | 28.0 | 1.0 | 0.2 | 0.5 | 0.1 | bal. | 13.8 | 12.6 |
| COMPARATIVE EXAMPLE 10 | 33.0 | 3.0 | 36.0 | 1.0 | 0.2 | 1.5 | 0.14 | bal. | 11.7 | 25.5 |

FIG. 31

| | AVE(X) | Y | AVE(X)／Y | (X／Y)min | (X／Y)max | (X／Y)max／(X／Y)min |
|---|---|---|---|---|---|---|
| EXAMPLE 11 | 6.40 | 7.10 | 0.90 | 0.41 | 1.34 | 3.27 |
| EXAMPLE 12 | 7.72 | 8.30 | 0.93 | 0.33 | 1.36 | 4.12 |
| COMPARATIVE EXAMPLE 9 | 7.81 | 7.10 | 1.10 | 0.91 | 1.15 | 1.26 |
| COMPARATIVE EXAMPLE 10 | 10.29 | 8.30 | 1.24 | 0.94 | 1.21 | 1.29 |

R-T-B BASED RARE EARTH PERMANENT MAGNET AND METHOD FOR PRODUCTION THEREOF

TECHNICAL FIELD

The present invention relates to an R-T-B system rare earth permanent magnet with excellent magnetic properties, which comprises R (wherein R represents one or more rare earth elements, providing that the term "rare earth element" includes Y (yttrium)), T (wherein T represents at least one transition metal element essentially containing Fe, or Fe and Co), and B (boron) as main components and to a production method thereof.

BACKGROUND ART

Among rare earth permanent magnets, an R-T-B system rare earth permanent magnet has been adopted in various types of electric equipment for the reasons that its magnetic properties are excellent and that its main component Nd is abundant as a source and relatively inexpensive.

However, such an R-T-B system rare earth permanent magnet with excellent magnetic properties also has several technical problems to be achieved. A technical problem to be achieved is that since an R-T-B system rare earth permanent magnet has low thermostability, its coercive force is significantly decreased along with an increase in temperature. Patent Document 1 (Japanese Patent Publication No. 5-10806) proposes that heavy rare earth elements including Dy, Tb, and Ho as typical examples are added to enhance the coercive force at room temperature, so as to keep the coercive force to such an extent that it does not impair the use of the permanent magnet, even though the coercive force is decreased due to an increase in temperature.

An R-T-B system rare earth permanent magnet comprises a sintered body comprising at least main phase grains comprising $R_2T_{14}B$ compounds and a grain boundary phase having a higher amount of R than the main phase. Patent Document 2 (Japanese Patent Application Laid-Open No. 7-122413) and Patent Document 3 (Japanese Patent Application Laid-Open No. 2000-188213) disclose the optimum concentration distribution of heavy rare earth elements in the main phase grains, which has a large influence upon magnetic properties, and a method for regulating such a concentration.

With regard to a rare earth permanent magnet, which comprises, as configuration phases, a main phase mainly comprising $R_2T_{14}B$ grains where R represents one or more rare earth elements, and T represents one or more transition metals and an R rich phase where R represents one or more rare earth elements, Patent Document 2 proposes that heavy rare earth elements are distributed at a high concentration at least at 3 points in the above described $R_2T_{14}B$ grains. Patent Document 2 describes that the R-T-B system rare earth permanent magnet is obtained by crushing each of an R-T-B system alloy comprising $R_2T_{14}B$ as a configuration phase and an R-T system alloy wherein the area ratio of R-T eutectics containing at least one of heavy rare earth element is 50% or less, and then mixing them, followed by compacting and sintering. The R-T-B system alloy preferably comprises $R_2T_{14}B$ grains as a configuration phase. It is recommended that the R-T-B system alloy have a composition consisting of 27 wt %≦R≦30 wt %, 1.0 wt %≦B≦1.2 wt %, and the balance being T.

Patent Document 3 discloses an R-T-B system rare earth permanent magnet, which comprises microstructures containing first $R_2T_{14}B$ main phase grains having a concentration of heavy rare earth elements that is higher than that of a grain boundary phase and second $R_2T_{14}B$ main phase grains having a concentration of heavy rare earth elements that is lower than that of a grain boundary phase, has a high residual magnetic flux density and a high value of the maximum energy product.

In order to obtain the aforementioned microstructures, Patent Document 3 adopts what is called the mixing method, which involves mixing two or more types of R-T-B system alloy powders containing different amounts of heavy rare earth elements such as Dy. In this case, regarding the composition of each type of R-T-B system alloy powders, the total amount of R elements is adjusted to be the same in all types of alloy powders. In the case of Nd+Dy for example, one type of alloy powders satisfies the composition of 29.0% Nd+1.0% Dy, and another type of alloy powders satisfies the composition of 15.0% Nd+15.0% Dy. In addition, regarding elements other than the R elements, it is preferable that all types of alloy powders contain substantially the same elements.

The R-T-B system rare earth permanent magnet described in Patent Document 2 has a coercive force (iHc) of approximately 14 kOe. Thus, it is desired that the coercive force be further improved.

Moreover, Patent Document 3 discloses a technique effective for improving the residual magnetic flux density and maximum energy product of an R-T-B system rare earth permanent magnet. However, it is difficult to obtain a sufficient coercive force by this technique. Thus, it is said that it is difficult to obtain both a high residual magnetic flux density and a high coercive force.

The present invention has been completed to solve the aforementioned technical problems. It is an object of the present invention to provide an R-T-B system rare earth permanent magnet capable of achieving both a high residual magnetic flux density and a high coercive force.

DISCLOSURE OF THE INVENTION

In order to achieve such an object, the present inventors have found that the determination of the concentration of heavy rare earth elements in an R-T-B system rare earth permanent magnet containing such heavy rare earth elements within a certain range is effective for achieving both a high residual magnetic flux density and a high coercive force.

That is to say, the R-T-B system rare earth permanent magnet of the present invention comprises a sintered body comprising at least: main phase grains comprising $R_2T_{14}B$ compounds (wherein R represents one or more rare earth elements, providing that the term "rare earth element" include Y (yttrium), and T represents one or more transition metal elements essentially containing Fe, or Fe and Co); and a grain boundary phase having a higher amount of R than the above described main phase grains, which is characterized in that sintered body satisfies the following formulas: AVE(X)/Y=0.8 to 1.0; and (X/Y)max/(X/Y)min=2.0 to 13.0, wherein X represents (the weight ratio of heavy rare earth elements)/(the weight ratio of all the rare earth elements) for a given number of the above described main phase grains in the above described sintered body, Y represents (the weight ratio of heavy rare earth elements)/(the weight ratio of all the rare earth elements) for the above described sintered body as a whole, AVE(X) represents the mean value of X obtained for the given number of the above described main phase grains, (X/Y)min represents the minimum value of (X/Y) obtained for the given number of the above described main phase grains, and (X/Y)max represents the maximum value of (X/Y) obtained for the given number of the above described main phase grains.

The R-T-B system rare earth permanent magnet of the present invention preferably satisfies the following formulas:

$(X/Y)\text{min}=0.1$ to 0.6; and $(X/Y)\text{max}=1.0$ to 1.6.

In addition, the R-T-B system rare earth permanent magnet of the present invention more preferably satisfies the following formulas: AVE(X)/Y=0.82 to 0.98; (X/Y)max/(X/Y)min=3.0 to 10.0; and (X/Y)min=0.1 to 0.5, and (X/Y)max=1.1 to 1.5.

Moreover, in the R-T-B system rare earth permanent magnet of the present invention, 85% or more of the total area occupied by the above described main phase grains (main phase) is preferably occupied by grains having a grain size of 15 μm or smaller; and 85% or more of the total area occupied by the above described main phase grains is more preferably occupied by grains having a grain size of 10 μm or smaller.

The R-T-B system rare earth permanent magnet of the present invention preferably has a composition consisting essentially of 25 to 37 wt % of R, 0.5 to 1.5 wt % of B, 0.03 to 0.3 wt % of Al, 0.15 wt % or less of Cu (excluding 0), 2 wt % or less of Co (excluding 0), and the balance substantially being Fe. In this case, the R-T-B system rare earth permanent magnet of the present invention may comprise 0.1 to 8.0 wt % of heavy rare earth elements as R.

The aforementioned R-T-B system rare earth permanent magnet of the present invention comprises a sintered body comprising at least: main phase grains comprising $R_2T_{14}B$ compounds (wherein R represents one or more rare earth elements, and T represents one or more transition metal elements essentially containing Fe, or Fe and Co); and a grain boundary phase having a higher amount of R than the above described main phase grains, wherein the sintered body comprises heavy rare earth elements as R. This R-T-B system rare earth permanent magnet can be produced by a method comprising the steps of: compacting, in a magnet field, a low R alloy powder mainly comprising an $R_2T_{14}B$ phase, and a high R alloy powder having a higher amount of R than the above described low R alloy powder and comprising Dy and/or Tb as such R, and sintering a compacted body obtained by the above described compacting in a magnetic field. Herein, the high R alloy powder contains 30 wt % or more of heavy rare earth elements contained in a sintered body.

Herein, the amount of heavy rare earth elements in the above described sintered body can satisfy the value between 0.1 and 8.0 wt %. Preferably, the high R alloy powder contains 50 wt % or more of the heavy rare earth elements contained in the sintered body. Moreover, as described above, the obtained sintered body preferably has a composition consisting essentially of 25 to 37 wt % of R, 0.5 to 1.5 wt % of B, 0.03 to 0.3 wt % of Al, 0.15 wt % or less of Cu (excluding 0), 2 wt % or less of Co (excluding 0), and the balance substantially being Fe.

When a sintered body with the aforementioned composition is obtained, in order to obtain high magnetic properties, low R alloy powder preferably has a composition consisting essentially of 25 to 38 wt % of R, 0.9 to 2.0 wt % of B, 0.03 to 0.3 wt % of Al, and the balance substantially being Fe, and high R alloy powder preferably has a composition consisting essentially of 26 to 70 wt % of R, 0.3 to 30 wt % of Co, 0.03 to 5.0 wt % of Cu, 0.03 to 0.3 wt % of Al, and the balance substantially being Fe.

BRIEF DESCRIPTION OF THE DRAWINGS

FIG. 1 is a table showing the compositions of the low R alloys and high R alloys used in the first example;

FIG. 2 is a table showing the chemical compositions and magnetic properties of sintered magnets obtained in the first example;

FIG. 5 is a table showing the measurement results regarding Dy concentration in the main phase grains of the sintered magnets obtained in the first example;

FIG. 6 is a table showing the chemical compositions and magnetic properties of sintered magnets obtained in the second example;

FIG. 7 is a table showing the measurement results regarding Dy concentration in the main phase grains of the sintered magnets obtained in the second example;

FIG. 12 is a table showing the compositions of the low R alloys and high R alloys used in the third example;

FIG. 13 is a table showing the chemical compositions and magnetic properties of sintered magnets obtained in the third example;

FIG. 16 is a table showing the measurement results regarding Dy concentration in the main phase grains of the sintered magnets obtained in the third example;

FIG. 17 is a table showing the measurement results regarding the grain sizes of the sintered magnets obtained in the third example;

FIG. 18 is a table showing the compositions of the low R alloys and high R alloys used in the fourth example;

FIG. 19 is a table showing the chemical compositions and magnetic properties of sintered magnets obtained in the fourth example;

FIG. 22 is a table showing the measurement results regarding Dy concentration in the main phase grains of the sintered magnets obtained in the fourth example;

FIG. 25 is a table showing the compositions of the low R alloys and high R alloys used in the fifth example;

FIG. 26 is a table showing the chemical compositions and magnetic properties of sintered magnets obtained in the fifth example;

FIG. 27 is a table showing the measurement results regarding Dy concentration in the main phase grains of the sintered magnets obtained in the fourth example;

FIG. 28 is a table showing the measurement results regarding the main phase grain sizes of the sintered magnets obtained in the fifth example;

FIG. 29 is a table showing the compositions of the low R alloys and high R alloys used in the sixth example;

FIG. 30 is a table showing the chemical compositions and magnetic properties of sintered magnets obtained in the sixth example; and FIG. 31 is a table showing the measurement results regarding Dy concentration in the main phase grains of the sintered magnets obtained in the sixth example.

BEST MODE FOR CARRYING OUT THE INVENTION

Figure 3A:
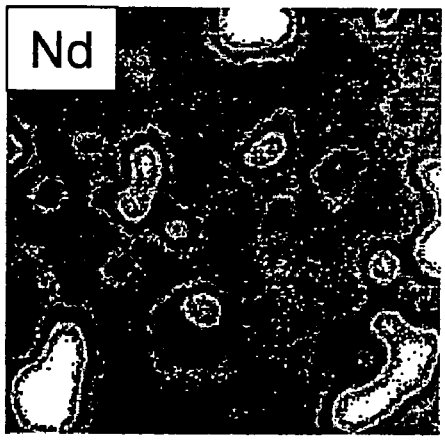
FIG. 3 shows the results of element mapping in Example 1.

The R-T-B system rare earth permanent magnet of the present invention will be described in detail below.

<Microstructures>

As is well known, the R-T-B system rare earth permanent magnet of the present invention comprises a sintered body comprising at least a main phase consisting essentially of $R_2T_{14}B$ grains where R represents one or more rare earth elements, and T represents one or more transition metal elements essentially containing Fe, or Fe and Co and a grain boundary phase having a higher amount of R than the above described main phase.

In the R-T-B system rare earth permanent magnet of the present invention, the concentration of heavy rare earth elements contained in the $R_2T_{14}B$ grains constituting the main phase of the sintered body greatly differs each grain. Moreover, the mean value (AVE(X)) of (the amount of heavy rare earth elements (wt %)/the amount of the all the rare earth elements (wt %) in main phase grains) (this value is referred to as X) is equal to or less than the value (the amount of heavy rare earth element (wt %)/the amount of the all the rare earth elements (wt %) in the sintered body as a whole) (this value is referred to as Y). This is important to impart a high residual magnetic flux density to the R-T-B system rare earth permanent magnet of the present invention. That is to say, it is understood that when the mean concentration of the heavy rare earth elements contained in the main phase grains playing a role in the magnetization of a magnet becomes low on average, the saturation magnetization (Ms) of the main phase grains increases, and that as a result, the residual magnetic flux density of a sintered body increases. To obtain a high residual magnetic flux density, it is particularly important for AVE(X)/Y to satisfy the value between 0.8 and 1.0.

In the R-T-B system rare earth permanent magnet of the present invention, it is particularly important for AVE (X)/Y to satisfy the value between 0.8 and 1.0.

If AVE(X) is less than 0.8, it is difficult to obtain a high coercive force. In contrast, if AVE(X) exceeds 1.0, the effect of improving a residual magnetic flux density cannot sufficiently be obtained. Thus, AVE(X)/Y is preferably between 0.82 and 0.98, and more preferably between 0.84 and 0.95.

In the present invention, with regard to the minimum value (X/Y)min and the maximum value (X/Y)max of X/Y obtained for given number of main phase grains, which are used as indexes for obtaining a high residual magnetic flux density, it is desired that the following formulas hold: $0.1 \leqq (X/Y)min \leqq 0.6$; and $1.0 \leqq (X/Y)max \leqq 1.6$. (X/Y)min is preferably between 0.1 and 0.5, and more preferably between 0.1 and 0.3. (X/Y)max is preferably between 1.1 and 1.5, and more preferably between 1.2 and 1.4. The above given number may be approximately 80.

(X/Y) max/(X/Y) min represents a concentration difference in heavy rare earth elements in the main phase. In the R-T-B system rare earth permanent magnet of the present invention, (X/Y)max/(X/Y)min preferably satisfies the value between 2.0 and 13.0, more preferably between 3.0 and 10.0, and further more preferably between 4.0 and 9.0.

In order to exert a high coercive force that the R-T-B system rare earth permanent magnet of the present invention originally has, it is preferable that in the above described R-T-B system rare earth permanent magnet, 85% or more of the total area occupied by the main phase grains be occupied by grains having a grain size of 15 μm or smaller. More preferably, 85% or more of the total area occupied by the main phase grains is occupied by grains having a grain size of 10 μm or smaller. This condition is used as an index indicating the fact that the R-T-B system rare earth permanent magnet of the present invention does not contain coarse grains. In the above described range, the mean grain size of main phase grains contained in the R-T-B system rare earth permanent magnet of the present invention is more preferably between 2.5 and 10 μm.

Thus, in order to obtain a sintered body that does not contain coarse main phase grains, it is adequate that the particle size of a pulverized powder be decreased, and that a sintering temperature be set low, as described later. The grain size and area of a main phase grain can be obtained by image analysis on the specular image of a polished surface of a sintered body observed with a microscope, as described in examples given later.

<Chemical Composition>

Next, a preferred chemical composition of the R-T-B system rare earth permanent magnet of the present invention will be described. The term "chemical composition" is used herein to mean a chemical composition obtained after sintering.

The R-T-B system rare earth permanent magnet of the present invention contains 25 to 37 wt % of rare earth elements (R)

Herein, R in the present invention has a concept of including Y (yttrium). Accordingly, R in the present invention represents one or more elements selected from the group consisting of Y (yttrium), La, Ce, Pr, Nd, Sm, Eu, Gd, Tb, Dy, Ho, Er, Tm, Yb, and Lu. If the amount of R is less than 25 wt %, an $R_2T_{14}B$ phase as a main phase of the R-T-B system rare earth permanent magnet might be insufficiently generated. Accordingly, α-Fe or the like having soft magnetic properties is precipitated, and the coercive force thereby significantly decreases. On the other hand, if the amount of R exceeds 37 wt %, the volume ratio of the $R_2T_{14}$ B phase as a main phase decreases, and the residual magnetic flux density also decreases. Moreover, if the amount of R exceeds 37 wt %, R reacts with oxygen, and the amount of oxygen thereby increases. In accordance with the increase of the oxygen amount, an R rich phase effective for the generation of the coercive force decreases, resulting in a reduction in the coercive force. Therefore, the amount of R satisfies the value between 25 and 37 wt %. The amount of R is preferably between 28 and 35 wt %, and more preferably between 29 and 33 wt %. It is to be noted that the amount of R herein includes that of heavy rare earth elements.

Since Nd and Pr are resourceful and relatively inexpensive, it is preferable to use Nd as a main component of R. In addition, the R-T-B system rare earth permanent magnet of the present invention contains heavy rare earth elements to improve the coercive force. The heavy rare earth elements of the present invention herein include one or more elements selected from the group consisting of Tb, Dy, Ho, Er, Tm, Yb, and Lu. Of these, it is most preferable that one or more elements be selected from the group consisting of Dy, Ho, and Tb. Accordingly, R contains Nd or Nd and Pr, and one or more selected from the group consisting of Dy, Ho, and Tb. Moreover, the total amount of Nd or Nd and Pr, and one or more selected from the group consisting of Dy, Ho, and Tb, satisfies the value between 25 and 37 wt %, and preferably between 28 and 35 wt %. Further, within the above range, the amount of one or more selected from the group consisting of Dy, Ho, and Tb, preferably satisfies the value between 0.1 and 8.0 wt %. The amount of one or more selected from the group consisting of Dy, Ho, and Tb, can be determined within the above range, depending on which is more important, the residual magnetic flux density or the coercive force. That is, when a high residual magnetic flux density is required, the amount of one or more selected from the group consisting of Dy, Ho, and Tb, is set at somewhat low, such as between 0.1 and 3.5 wt %. In contrast, when a high coercive force is required, the above amount is set at somewhat high, such as between 3.5 and 8.0 wt %.

In addition, the R-T-B system rare earth permanent magnet of the present invention contains 0.5% to 4.5 wt % of boron (B). If the amount of B is less than 0.5 wt %, a high coercive force cannot be obtained. However, if the amount of B exceeds 4.5 wt %, the residual magnetic flux density is likely to decrease. Accordingly, the upper limit satisfies 4.5 wt %. The amount of B is preferably between 0.5 and 1.5 wt %, and more preferably between 0.8 and 1.2 wt %.

Moreover, the R-T-B system rare earth permanent magnet of the present invention may contain Al and/or Cu within the range between 0.02 and 0.5 wt %. The containment of Al and/or Cu within the above range can impart a high coercive force, a strong corrosion resistance, and an improved temperature stability of magnet properties to the obtained R-T-B system rare earth permanent magnet. When Al is added, the additive amount of Al is preferably between 0.03 and 0.3 wt %, and more preferably between 0.05 and 0.25 wt %. When Cu is added, the additive amount of Cu is preferably 0.15 wt % or less (excluding 0), and more preferably between 0.03 and 0.12 wt %.

Furthermore, the R-T-B system rare earth permanent magnet of the present invention contains Co in an amount of 2.0 wt % or less (excluding 0), preferably between 0.1 and 1.0 wt %, and more preferably between 0.3 and 0.7 wt %. Co forms a phase similar to that of Fe. Co has an effect to improve Curie temperature and the corrosion resistance of a grain boundary phase.

The R-T-B system rare earth permanent magnet of the present invention is permitted to contain other elements. For example, it can appropriately contain elements such as Zr, Ti, Bi, Sn, Ga, Nb, Ta, Si, V, Ag, or Ge. On the other hand, it is desired that impurity elements such as oxygen, nitrogen, or carbon be reduced to the minimum. In particular, the amount of oxygen impairing magnetic properties is preferably set at 5,000 ppm or less. If the amount of oxygen is large, a rare earth oxide phase as a non-magnetic component increases, thereby reducing magnetic properties.

<Production Method>

The R-T-B system rare earth permanent magnet of the present invention can be produced by the mixing method, which involves mixing powders comprising an alloy (hereinafter referred to as a low R alloy) mainly containing a $R_2T_{14}B$ phase, with powders comprising an alloy (hereinafter referred to as a high R alloy) containing a higher amount of R than the low R alloy. In addition, heavy rare earth elements are preferably added to the high R alloy to obtain the microstructures of the present invention. Based on the above preconditions, a preferred method for producing the R-T-B system rare earth permanent magnet of the present invention will be described below.

Both the low R alloy and the high R alloy can be produced by strip casting or other known dissolution methods in a vacuum or an inert gas atmosphere, and preferably in an Ar atmosphere.

The low R alloy contains Cu and Al as constitutional elements, as well as rare earth elements, Fe, Co, and B. The chemical composition of the low R alloy can appropriately be determined depending on the chemical composition of a desired R-T-B system rare earth permanent magnet. The low R alloy preferably has a composition consisting essentially of 25 to 38 wt % of R, 0.9 to 2.0 wt % of B, 0.03 to 0.3 wt % of Al, and the balance being Fe. In order to obtain the R-T-B system rare earth permanent magnet of the present invention, it is important that the amount of rare earth elements contained in the low R alloy satisfies 30 wt % or more. By setting the amount of rare earth elements contained in the low R alloy at rather high, a sinterability is improved, and the aforementioned microstructures are obtained. In order to obtain microstructures having the characteristics of the present invention also, it is preferable that the amount of rare earth elements contained in the low R alloy satisfies 30 wt % or more.

On the other hand, the high R alloy may also contain Cu and Al, as well as rare earth elements, Fe and Co. The chemical composition of the high R alloy can appropriately be determined depending on the chemical composition of a desired R-T-B system rare earth permanent magnet. The high R alloy preferably has a composition consisting essentially of 26 to 70 wt % of R, 0.3 to 30 wt % of Co, 0.03 to 5.0 wt % of Cu, 0.03 to 0.3 wt % of Al, and the balance being Fe. Herein, heavy rare earth elements are required to be contained in the high R alloy. This is necessary for obtaining the aforementioned microstructures of the present invention. If such heavy rare earth elements were contained in only the low R alloy, the aforementioned microstructures of the present invention could not be obtained. As long as the high R alloy contains heavy rare earth elements, the low R alloy may also contain such heavy rare earth elements. That is to say, the present invention includes a case where heavy rare earth elements are contained in only the high R alloy and a case where heavy rare earth elements are contained both in the low R alloy and in the high R alloy. When heavy rare earth elements are contained both in the low R alloy and in the high R alloy, it is preferable that the high R alloy contain 30 wt % or more of, and preferably 50 wt % or more of the amount of heavy rare earth elements that are finally contained.

The low R alloy and the high R alloy as raw material alloys are crushed separately or together. The crushing process generally includes a crushing step and a pulverizing step.

First, the low R alloy and the high R alloy are crushed to a particle size of approximately several hundreds of μm in the crushing step. The crushing is preferably carried out in an inert gas atmosphere, using a stamp mill, a jaw crusher, a brown mill, etc. In order to improve rough crushability, it is effective to carry out crushing after performing a hydrogen absorption and releasing treatment.

After carrying out the crushing, the routine proceeds to a pulverizing step. Crushed powders with a particle size of approximately several hundreds of μm are pulverized to a mean particle size between 3 and 5 μm. In the present invention, by using such fine powders and also by setting the amount of rare earth elements contained in the low R alloy at somewhat high, both a high residual magnetic flux density and a high coercive force can be obtained even in a relatively low sintering temperature range. A jet mill can be used in the pulverizing.

When the low R alloy and the high R alloy are pulverized separately in the pulverizing step, the pulverized low R alloy powders are mixed with the pulverized high R alloy powders in a nitrogen atmosphere. The mixing ratio of the low R alloy powders to the high R alloy powders may be selected from the range between 80:20 and 97:3, at a weight ratio. Likewise, in a case where the low R alloy is pulverized together with the high R alloy also, the same above mixing ratio may be applied. For the purpose of improving orientation during compacting, approximately 0.01 to 0.3 wt % of an additive such as zinc stearate or oleic amide can be added during the pulverizing step.

Subsequently, the obtained mixed powders comprising the low R alloy powders and the high R alloy powders are compacted in a magnetic field. This compacting (in a magnetic field) may be carried out by applying in a magnetic field between 12.0 and 17.0 kOe (955 to 1,353 kA/mMPa) a pressure between approximately 0.7 and 2.0 t/cm$^2$ (69 to 196 MPa).

After completion of the compacting in a magnetic field, the obtained compacted body is sintered in a vacuum or an inert gas atmosphere. The sintering temperature needs to be adjusted depending on various conditions such as a composition, a crushing method, or the difference between particle size and particle size distribution, but the compacted body may be sintered at 1,000° C. to 1,150° C. for about 1 to 5 hours. The R-T-B system rare earth permanent magnet of the present invention has an effect of obtaining a high residual magnetic flux density and a high coercive force even by sintering in a relatively low temperature range, such as a temperature of 1,050° C. or lower, within the above range.

After completion of the sintering, the obtained sintered body may be subjected to an aging treatment. The aging treatment is important for the control of a coercive force. When the aging treatment is carried out in two steps, it is effective to retain the sintered body for a certain time at around 800° C. and around 600° C. When a heat treatment is carried out at around 800° C. after completion of the sintering, the coercive force increases. Accordingly, such a heat treatment at around 800° C. is particularly effective in the mixing method. Moreover, when a heat treatment is carried out at around 600° C., the coercive force significantly increases. Accordingly, when the aging treatment is carried out in a single step, it is appropriate to carry out it at around 600° C.

Next, the present invention will be described in more detail in the following specific examples.

FIRST EXAMPLE

A low R alloy and a high R alloy were prepared by high frequency dissolution in an Ar atmosphere. The composition of the low R alloy and that of the high R alloy are shown in FIG. 1. In FIG. 1, Dy as a heavy rare earth element was added to the high R alloy in Examples 1 and 2, whereas it was added to the low R alloy in Comparative examples 1 and 2.

The prepared low R alloy and high R alloy were allowed to absorb hydrogen at room temperature, and are then subjected to a dehydrogenation treatment at 600° C. for 1 hour in an Ar atmosphere.

After completion of the hydrogen absorption and dehydrogenation treatment, the low R alloy and the high R alloy were crushed by a brown mill in a nitrogen atmosphere. Thereafter, they were pulverized by a jet mill using high-pressure nitrogen gas, so as to obtain pulverized powders with a mean particle size of 3.5 μm. It is to be noted that the low R alloy was mixed with the high R alloy during the crushing, and that 0.05% of oleic amide was added as a crushing agent before carrying out the pulverizing.

The obtained fine powders were compacted in a magnetic field of 1,200 kA/m (15 kOe) by applying a pressure of 147 MPa (1.5 ton/cm$^2$), so as to obtain a compacted body. This compacted body was sintered at 1,030° C. for 4 hours in a vacuum atmosphere followed by quenching. Thereafter, the obtained sintered body was subjected to a two-step aging treatment consisting of 850° C.×1 hour and 540° C.×1 hour (wherein both the steps were carried out in an Ar atmosphere).

The chemical composition of the obtained sintered magnet was obtained by fluorescent X-ray analysis. In addition, the residual magnetic flux density (Br) and the coercive force (HcJ) were measured with a B-H tracer. The results are shown in FIG. 2.

As shown in FIG. 2, the chemical compositions of the sintered magnets obtained in Examples 1 and 2 and Comparative examples 1 and 2 are almost same. Also, coercive force (Hcj) of the sintered magnets are almost same. However, the sintered magnets in Examples 1 and 2 exhibit 200 to 400 G higher residual magnetic flux densities (Br) than those in Comparative examples 1 and 2.

With regard to the sintered bodies in Example 1 and Comparative example 1, the element mapping was carried out using EPMA (Electron Probe Micro Analyzer; EPMA-1600 manufactured by Shimadzu Corp.). FIG. 3 shows the results regarding Example 1, and FIG. 4 shows the results regarding Comparative example 1. It is to be noted that FIGS. 3A to 3C and FIGS. 4A and 4C show the results regarding the element mapping of Nd, Pr, and Dy, respectively, and that FIGS. 3D and 4D show a reflection electron image in the same field of view as that in the element mapping.

Figure 3B:
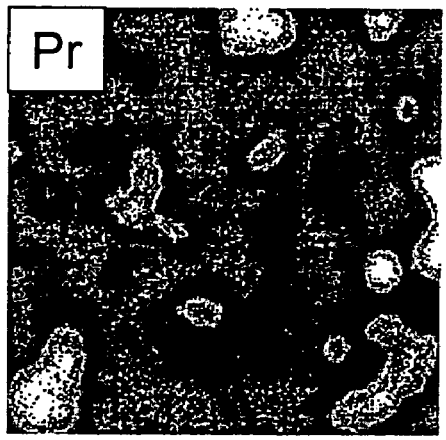
Figure 3C:
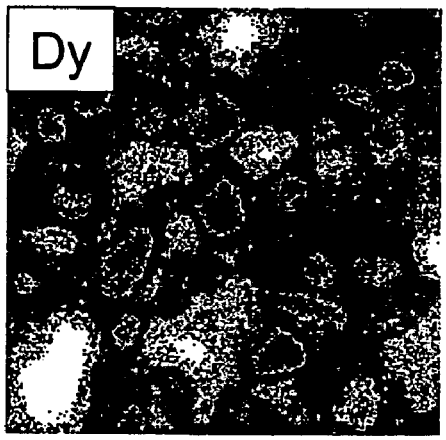
Figure 3D:
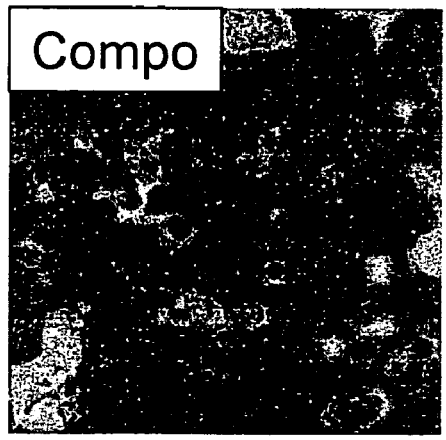

When FIGS. 3A, 3B and 3C are compared with FIG. 3D, hypochromic regions of FIGS. 3A, 3B and 3C corresponding to a white region of FIG. 3D have high concentrations of elements Nd, Pr, and Dy, respectively. Thus, these regions represent grain boundary triple points. Hereinafter, such a region may be referred to as an R rich phase at times. In addition, from the comparison between a white region of FIG. 4D and regions of FIGS. 4A, 4B and 4C it is found that the white region represents an R rich phase.

Figure 4A:
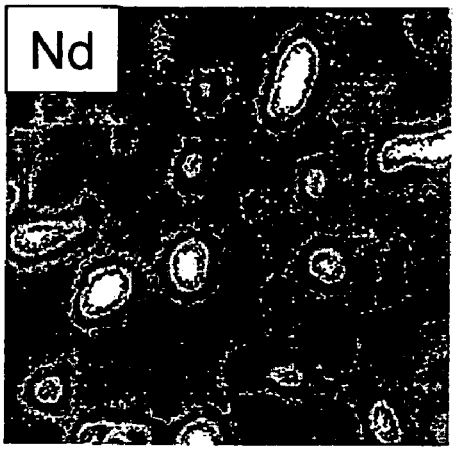
FIG. 4 shows the results of element mapping in Comparative example 1.
Figure 4B:
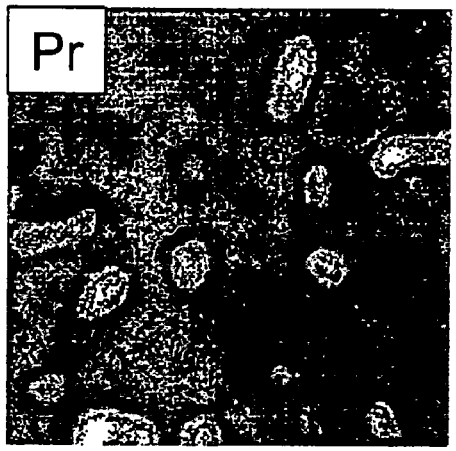
Figure 4C:
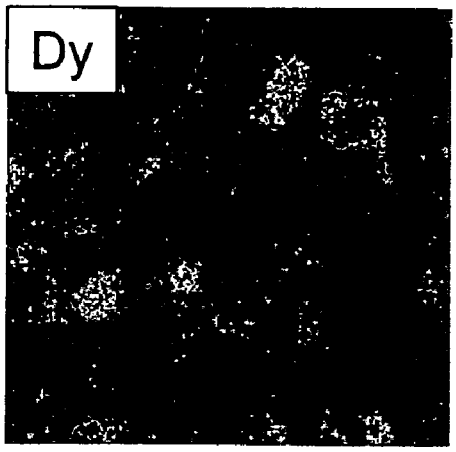
Figure 4D:
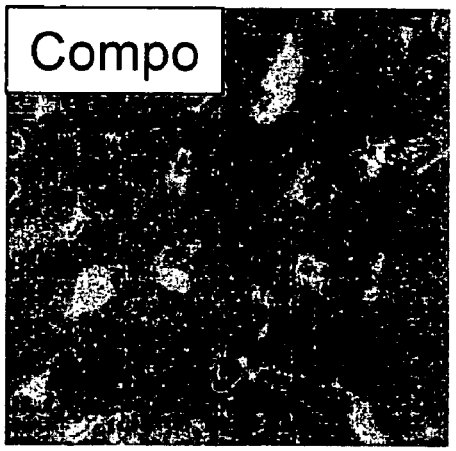
Figure 8:
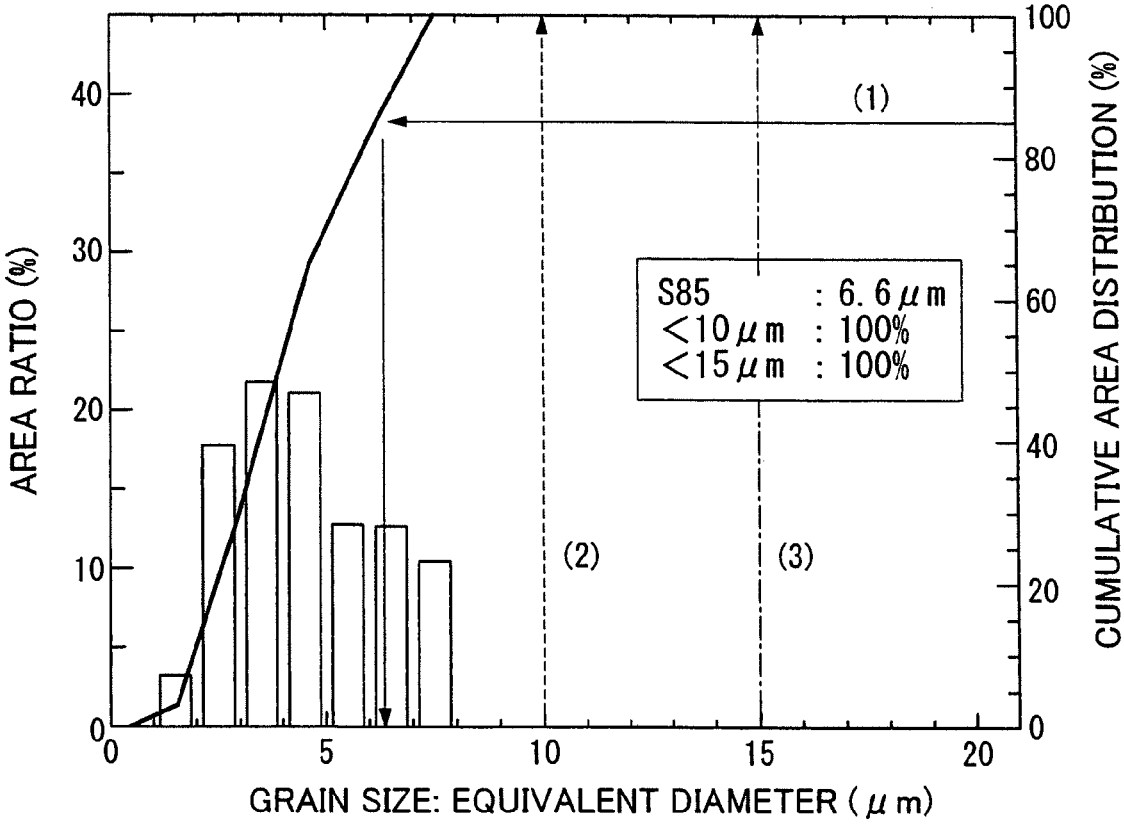
FIG. 8 is a graph showing the equivalent diameter of main phase grains and the area ratio thereof, which were obtained by image analysis on the specular image of a polished surface observed with a microscope in Example 1.
Figure 9:
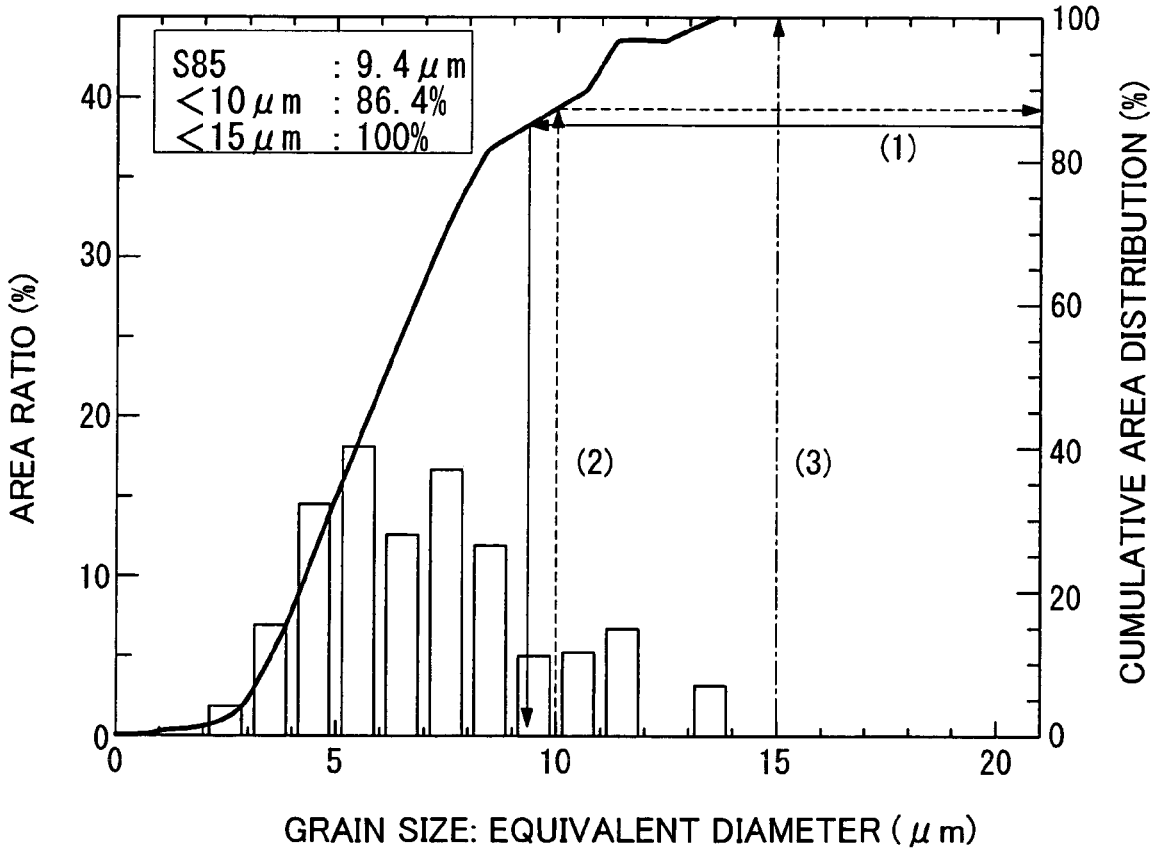
FIG. 9 is a graph showing the equivalent diameter of main phase grains and the area ratio thereof, which were obtained by image analysis on the specular image of a polished surface observed with a microscope in Example 3.
Figure 10:
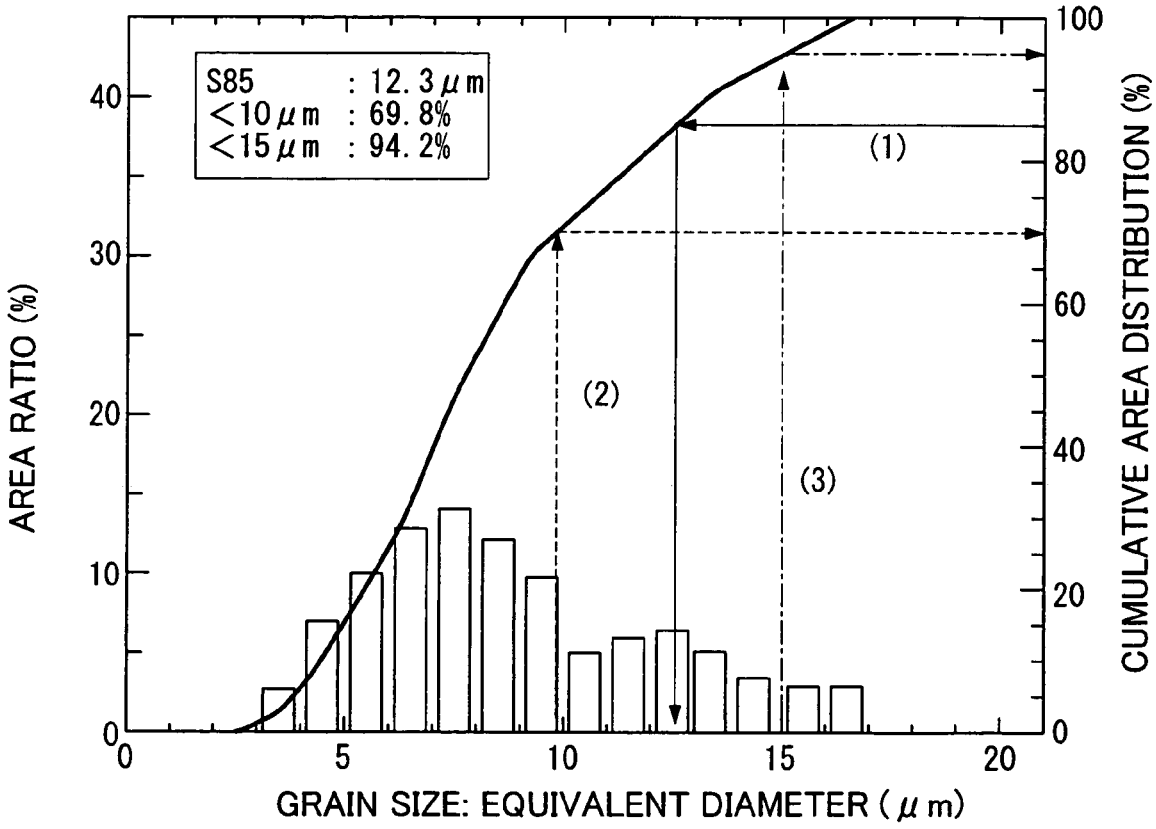
FIG. 10 is a graph showing the equivalent diameter of main phase grains and the area ratio thereof, which were obtained by image analysis on the specular image of a polished surface observed with a microscope in Example 4.
Figure 11:
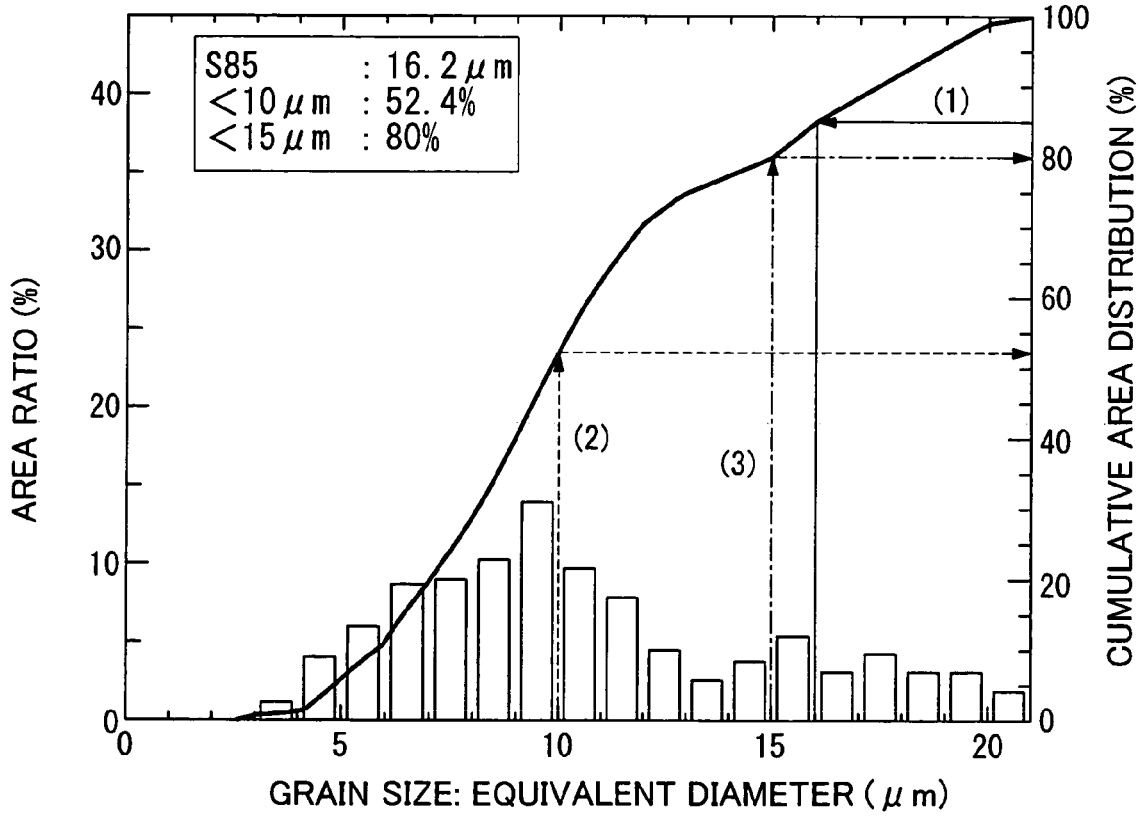
FIG. 11 is a graph showing the equivalent diameter of main phase grains and the area ratio thereof, which were obtained by image analysis on the specular image of a polished surface observed with a microscope in Example 5.
Figure 14A:
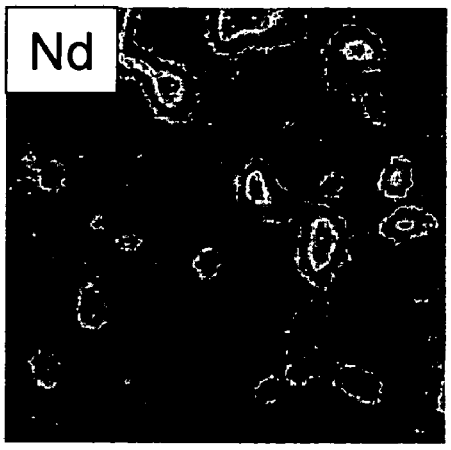
FIG. 14 shows the results of element mapping in Example 6.
Figure 14B:
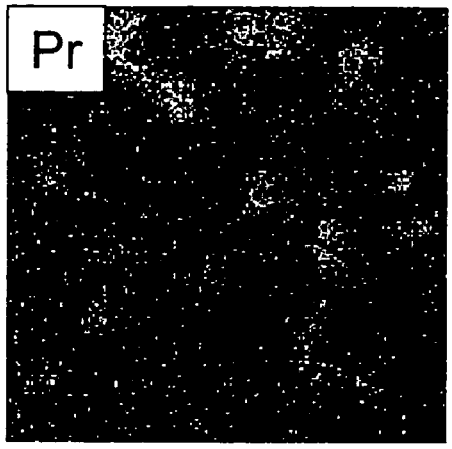
Figure 14C:
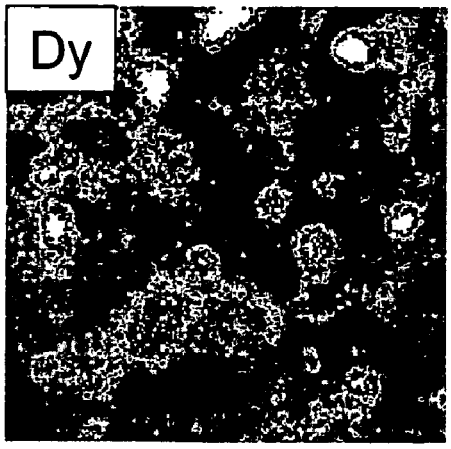
Figure 14D:
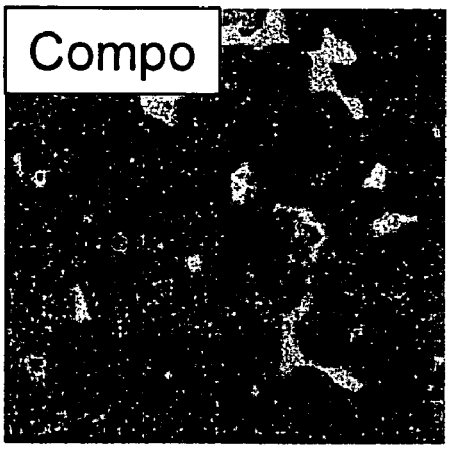
Figure 15A:
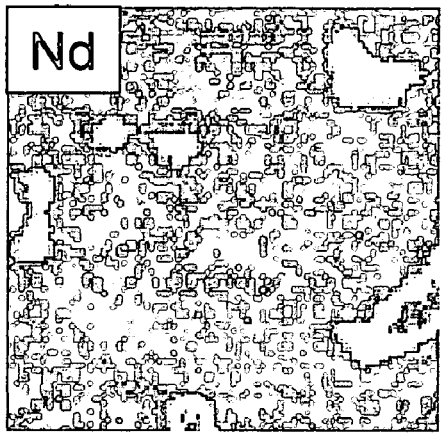
FIG. 15 shows the results of element mapping in comparative example 3.
Figure 15B:
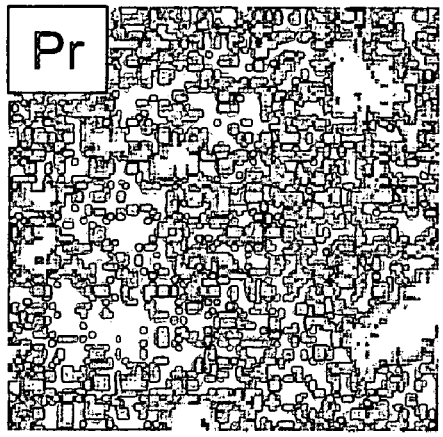
Figure 15C:
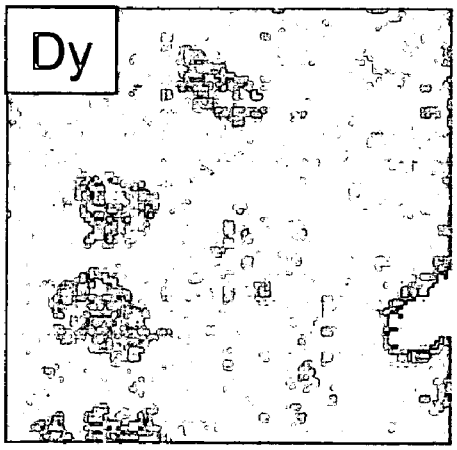
Figure 15D:
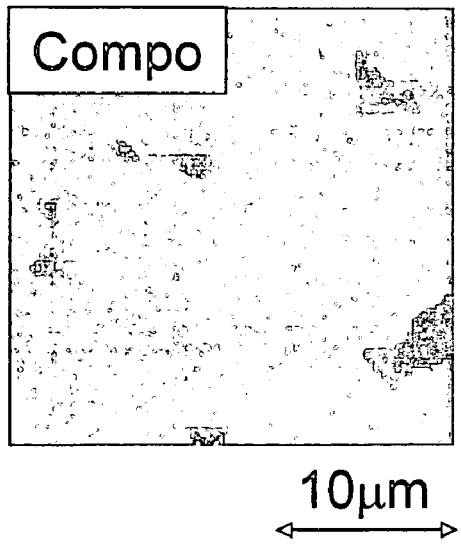
Figure 20A:
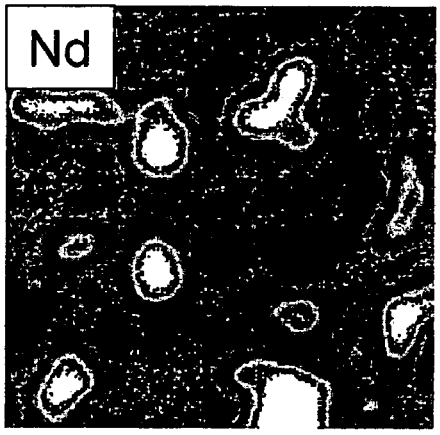
FIG. 20 shows the results of element mapping in comparative example 5.
Figure 20B:
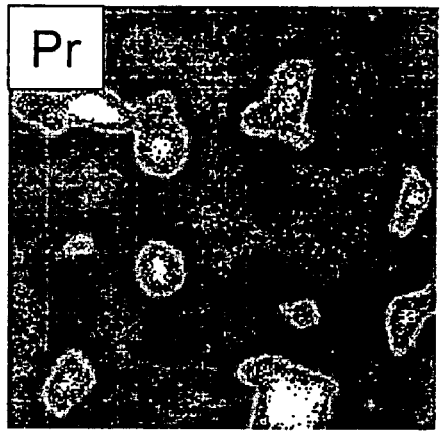
Figure 20C:
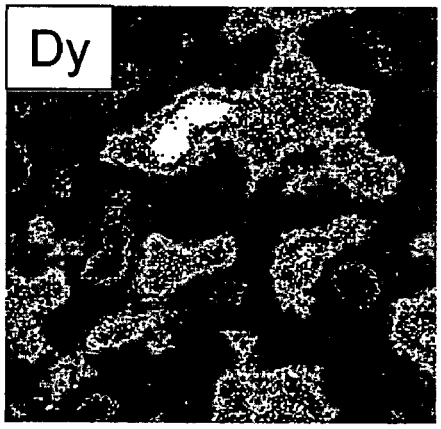
Figure 20D:
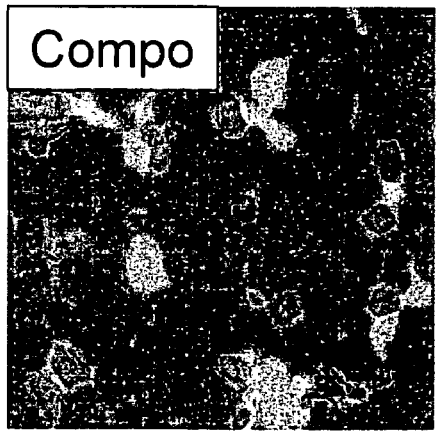
Figure 21A:
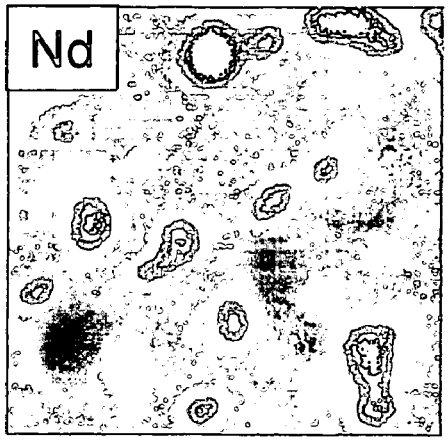
FIG. 21 shows the results of element mapping in Comparative example 6.
Figure 21B:
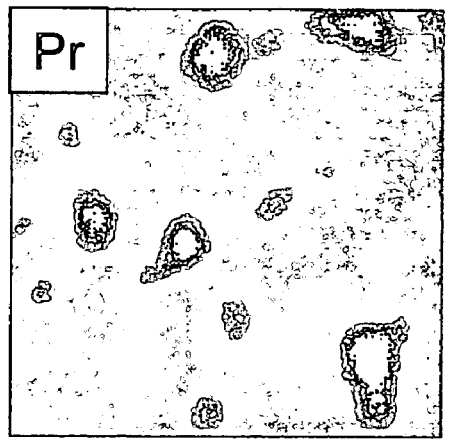
Figure 21C:
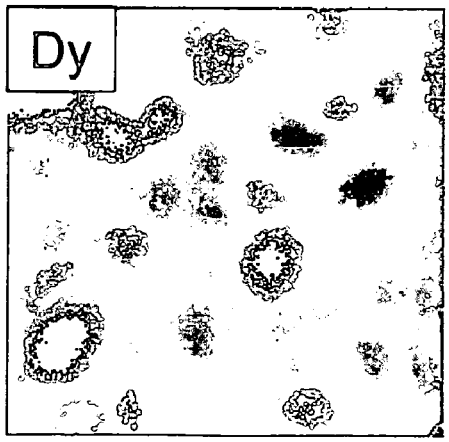
Figure 21D:
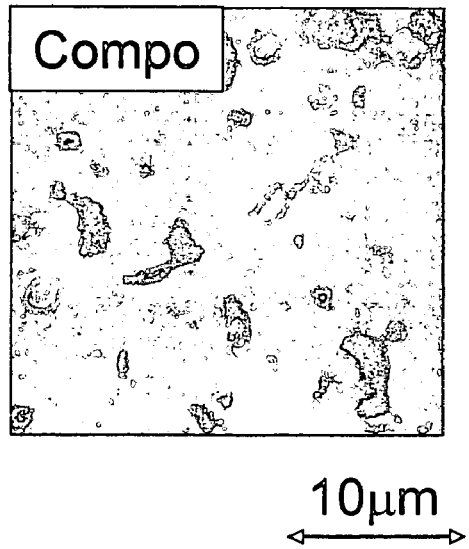

As shown in FIG. 4C, it is found that the concentration of Dy in Comparative example 1 is almost uniform and is lower than that in an R rich phase, except for in the case of the R rich phase. In contrast, as shown in FIG. 3C, the region of a main phase other than the R rich phase has both light and shade portions in Example 1, and thus, it is found that there exist portions where the concentration of Dy is high and portions where the concentration of Dy is low. These results show that the R-T-B system rare earth permanent magnet in Example 1 is an R-T-B system rare earth permanent magnet wherein main phase grains with a high Dy concentration are mixed with main phase grains with a low Dy concentration.

As stated above, Example 1 largely differs from Comparative example 1 in terms of the distribution state of Dy.

Subsequently, with regard to main phase grains constituting the sintered body in Example 1 and those constituting the sintered body in Comparative example 1, quantitative analysis was carried out regarding 3 elements Nd, Dy, and Pr. The analysis was carried out on 80 main phase grains from each sintered body, using the aforementioned EPMA.

Based on the results of the aforementioned quantitative analysis and the results of the composition analysis of the sintered body as a whole with the aforementioned fluorescent X-ray, the following values were calculated. The results are shown in FIG. 5.

X=(wt % of Dy)/(wt % of TRE) in the main phase grains

Y=(wt % of Dy)/(wt % of TRE) in the sintered body as a whole (The mean value of X)/Y=AVE(X)/Y The minimum value of X/Y=(X/Y)min, the maximum value of X/Y=(X/Y)max, and TRE=Dy+Nd+Pr As shown in FIG. 5, Y that is the ratio of the Dy amount to the TRE amount in the sintered body as a whole indicates a value around 9 both in Example 1 and Comparative example 1, and thus, there are no significant differences. However, the mean value of X (AVE(X)) that is the ratio of the Dy amount to the TRE amount in the main phase grains in Example 1 is clearly smaller than that in Comparative example 1. Accordingly, it is found that the AVE(X)/Y in Example 1 is a value that is 1 or less and is smaller than the value in Comparative example 1. Namely, there are no differences between Example 1 and Comparative example 1 in terms of the composition of the sintered body as a whole. However, regarding the main phase grains, the concentration of Dy in the main phase in Example 1 is lower than that in Comparative example 1. As a result, it is understood that a mean saturation magnetization (Ms) in Example 1 becomes higher than that in Comparative example 1, and that the residual magnetic flux density (Br) in Example 1 is thereby improved.

Regarding Example 2 and Comparative example 2 also, as shown in FIG. 5, the same results as those in Example 1 and Comparative example 1 were obtained.

As shown in FIG. 5, Examples 1 and 2 have (X/Y)min of 0.12 and 0.15, (X/Y)max of 1.43 and 1.33, and (X/Y)max/(X/Y)min of 11.92 and 8.87, respectively. In contrast, Comparative examples 1 and 2 have (X/Y)min of 1.01 and 1.05, (X/Y)max of 1.25 and 1.27, and (X/Y)max/(X/Y)min of 1.24 and 1.21, respectively. Thus, it was confirmed that the Dy concentration in the main phase grains in Examples 1 and 2 was more variable than that in Comparative examples 1 and 2.

SECOND EXAMPLE

A low R alloy and a high R alloy, which have the same compositions as those in Example 1, were prepared. Sintered magnets were produced in the same processes as those in the first example with the exception that the particle size (mean particle size) of a pulverized powder and the sintering temperature were changed as follows. Regarding the obtained sintered magnets, the same composition analysis and measurement of magnetic properties as those in Example 1 were carried out. The results are shown in FIG. 6.

Example 1: the particle size of a pulverized powder =3.5 μm, the sintering temperature =1,030° C.

Example 3: the particle size of a pulverized powder =3.5 μm, the sintering temperature =1,050° C.

Example 4: the particle size of a pulverized powder =4.5 μm, the sintering temperature =1,030° C.

Example 5: the particle size of a pulverized powder =4.5 μm, the sintering temperature =1,050° C.

As shown in FIG. 6, the compositions of the sintered bodies are almost the same in Examples 1 and 3 to 5. However, when compared with the residual magnetic flux density (Br) and the coercive force (HcJ) in Examples 1 and 3 to 5, although the coercive force (HcJ) tends to slightly decrease along with an increase in the sintering temperature, a high coercive force of 21.0 kOe or more can be obtained in all Examples 1 and 3 to 5. Comparing Example 1 with Example 4, and Example 3 with Example 5, it is found that a higher coercive force (HcJ) can be obtained as the particle size of a pulverized powder decreases.

FIG. 7 shows AVE(X), Y, AVE(X)/Y, (X/Y)min, and (X/Y)max, which were obtained in the same manner as in the first example. The obtained values are not significantly different in Examples 1 and 3 to 5.

Regarding the sintered bodies in Examples 1 and 3 to 5, the specular image of a polished surface thereof observed with a microscope was subjected to image analysis, so as to obtain the equivalent diameter of a main phase grain and the area ratio thereof. The results are shown in FIGS. 8 to 11.

In FIGS. 8 to 11, a main phase grain size is divided into every 1 μm. The bar chart indicates the ratio of the total area of the main phase grains included in the above range to the total area of all particles to be measured. For example, the bar graph corresponding to the horizontal axis from 4 μm to 5 μm in each of FIGS. 8 to 11 indicates the ratio of the total area of the main phase grains whose grain size is in a range between 4 μm and 5 μm to the total area of all particles to be measured.

In addition, in FIGS. 8 to 11, the line graph indicates the area that is integrated in increasing order of the grain size of a main phase grain.

In Examples 1 and 3 to 5, a grain size at which the cumulative area of smaller-size grains in the main phase reaches 85% of the total area of all the main phase grains (hereinafter referred to as "S85" at times); the ratio of the cumulative area of the main phase grains with a grain size of less than 10 μm to the total area of all the main phase grains (hereinafter referred to as "<10 μm" at times); and the ratio of the cumulative area of the main phase grains with a grain size of less than 15 μm to the total area of all the main phase grains (hereinafter referred to as "<15 μm" at times) were obtained. The results are shown in FIGS. 8 to 11. The fact that the value of "S85" becomes greater or, in contrary, the value of "<10 μm" or "<15 μm" becomes smaller, means that the ratio of coarse particles in a sintered body increases. In addition, in FIGS. 8 to 11, solid line (1) represents "S85," dotted line (2) represents "<10 μm," and dashed line (3) represents "<15 μm."

From FIGS. 8 to 11, it is found that the value of "S85" becomes greater in the order of Examples 1, 3, 4, and 5, and thus that the ratio of coarse particles increases in the above order. As shown in FIG. 6, the coercive force (HcJ) becomes lower in the order of Examples 1, 3, 4, and 5. Thus, in order to obtain a high coercive force (HcJ), the value of "S85" preferably satisfies 15 μm or less (Examples 1, 3, and 4), and more preferably satisfies 10 μm or less (Examples 1 and 3).

THIRD EXAMPLE

Sintered magnets were produced in the same processes as those in the first example with the exceptions that low R alloys and high R alloys shown in FIG. 12 were used, that the particle sizes of the pulverized powders were set as described below, and that the sintering temperature was set at 1,070° C. Regarding the obtained sintered magnets, the same measurement and observation as those in the first example were carried out. The chemical compositions of the obtained sintered bodies and the magnetic properties thereof are shown in FIG. 13. The results regarding element mapping are shown in FIG. 14 (Example 6) and FIG. 15 (Comparative example 3). In Example 6, the Dy amount contained in the high R alloy powders was 37 wt % with respect to the Dy amount contained in the sintered body. In Example 7, the Dy amount contained in the high R alloy powders was 52 wt % with respect to the Dy amount contained in the sintered body.

In addition, the AVE(X), Y, AVE(X)/Y, (X/Y)min, and (X/Y)max of each sintered magnet are shown in FIG. 16. Moreover, "S50," "S85 ," "<10 μm," and "<15 μm" of each sintered magnet were obtained. "S50" represents a grain size at which the cumulative area of smaller-size grains in the main phase reaches 50% of the total area of the main phase grains. This value means a mean grain size in the present invention. The results are shown in FIG. 17.

Example 6 =4.6 μm, Example 7 =4.8 μm,

Comparative example 3 =5.8 μm, and Comparative example 4 =5.9 μm

As shown in FIG. 13, the chemical compositions of the sintered magnets obtained in Example 6 and Comparative example 3, and those in Example 7 and Comparative example 4, are each almost same. Also, these sintered magnets have the almost same value of coercive force (HcJ). However, the sintered magnets in Examples 6 and 7 exhibit 200 to 400 G higher residual magnetic flux densities (Br) than those in Comparative examples 3 and 4. It is to be noted that the amount of Dy is high in the third example, a high coercive force (HcJ) can be obtained.

As shown in FIG. 14, as in the case of Example 1, the sintered magnet in Example 6 contains portions with a high Dy concentration and portions with a low Dy concentration even in the region other than an R rich phase. In contrast, as in the case of Comparative example 1, the concentration of Dy in Comparative example 3 shown in FIG. 15 is almost uniform and is lower than that in an R rich phase, in the region of a main phase except for the R rich phase and some other exceptions.

As shown in FIG. 16, the value of Y is almost the same between Example 6 and Comparative example 3, and between Example 7 and Comparative example 4. However, the value of AVE (X) in Example 6 is clearly smaller than that in Comparative example 3. Accordingly, the value of AVE (X)/Y in Example 6 becomes a value that is 1 or less and is smaller than the value obtained in Comparative example 3. That is to say, with regard to the composition of the sintered body as a whole, the Dy concentration in the main phase grains in Example 6 is lower than that in Comparative example 3. As a result, it is understood that a mean saturation magnetization (Ms) in Example 6 becomes higher than that in Comparative example 3, and that the residual magnetic flux density (Br) is thereby improved. The same tendencies are observed regarding Example 7 and Comparative example 4.

The (X/Y)min values in Examples 6 and 7 are within the range of the present invention (0.1 to 0.6). However, the (X/Y)min values in Comparative examples 3 and 4 are 0.88 and 0.73, respectively. Thus, these values are beyond the range of the present invention.

As shown in FIG. 17, Examples 6 and 7 have "S50" that is in a range between 8 and 10 μm, and have "S85" of 15 μm or less. Moreover, the ratio "<15 μm" is 85% or more, and the ratio "<10 μm" is 50% or more. In contrast, Comparative examples 3 and 4 have "S50" that is in a range between 10 and 13 μm, and have "S85" of more than 15 μm. Moreover, the ratio "<15 μm" is less than 80%, and the ratio "<10 μm" is less than 50%.

FOURTH EXAMPLE

Sintered magnets were produced in the same processes as those in the first example with the exceptions that the low R alloys and high R alloys shown in FIG. 18 were used, that the grain sizes of the pulverized powders were set as described below, and that the sintering temperature was set at 1,030° C. Regarding the obtained sintered magnets, the same measurement and observation as those in the first example were carried out. The chemical compositions of the obtained sintered bodies and the magnetic properties thereof are shown in FIG. 19. The results regarding element mapping are shown in FIG. 20 (Comparative example 5) and FIG. 21 (Comparative example 6). In addition, the AVE(X), Y, AVE(X)/Y, (X/Y) min, and (X/Y)max of each sintered magnet are shown in FIG. 22. Moreover, the ratio X/Y to the main phase grains to be measured is shown in FIG. 23 (Comparative example 5) and FIG. 24 (Comparative example 6).

Example 8 =3.2 μm, Comparative example 5 =3.0 μm, and Comparative example 6 =3.1 μm As shown in FIG. 22, the chemical compositions of the sintered magnets obtained in Example 8 and Comparative examples 5 and 6 are almost same. Also, these sintered magnets have the almost same value of residual magnetic flux density (Br) However, it is clear that the coercive force (HcJ) in Comparative examples 5 and 6 is inferior to that in Example 8.

Referring to FIGS. 20 and 21, as in the case of Example 1, portions with a high Dy concentration and portions with a low Dy concentration exist in the main phase region except for an R rich phase, both in Comparative examples 5 and 6. Regardless of such fact, the coercive force (HcJ) in Comparative examples 5 and 6 is lower than that in Example 8, as described above.

Figure 23:
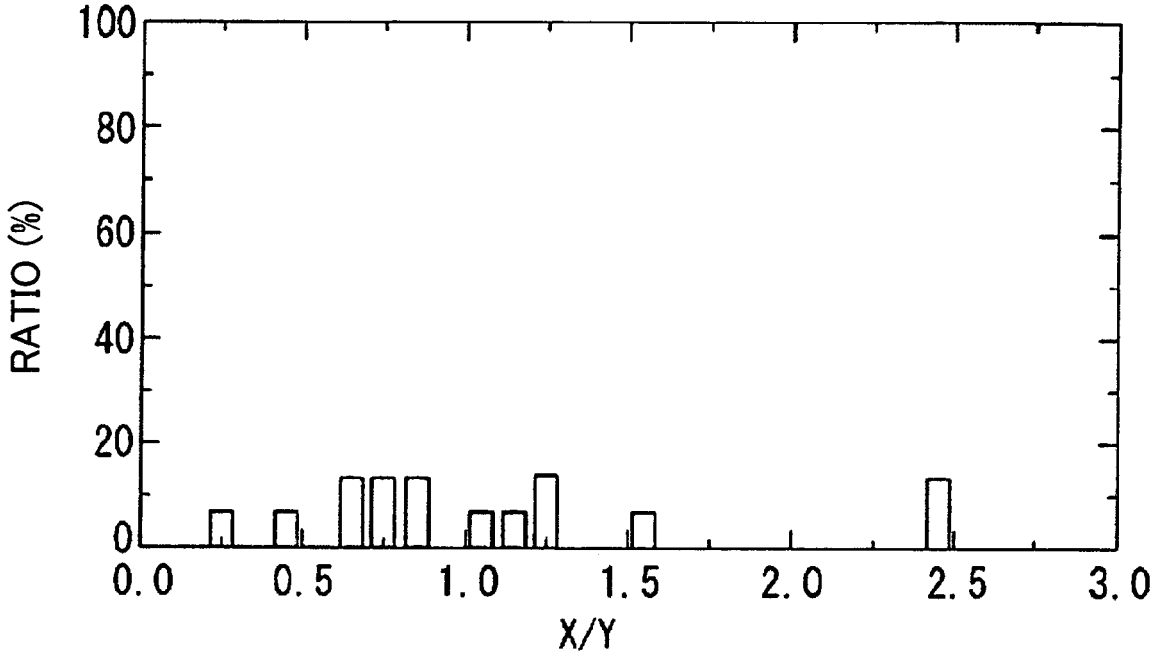
FIG. 23 is a graph showing the ratio X/Y to main phase grains that were measurement targets in Comparative example 5.
Figure 24:
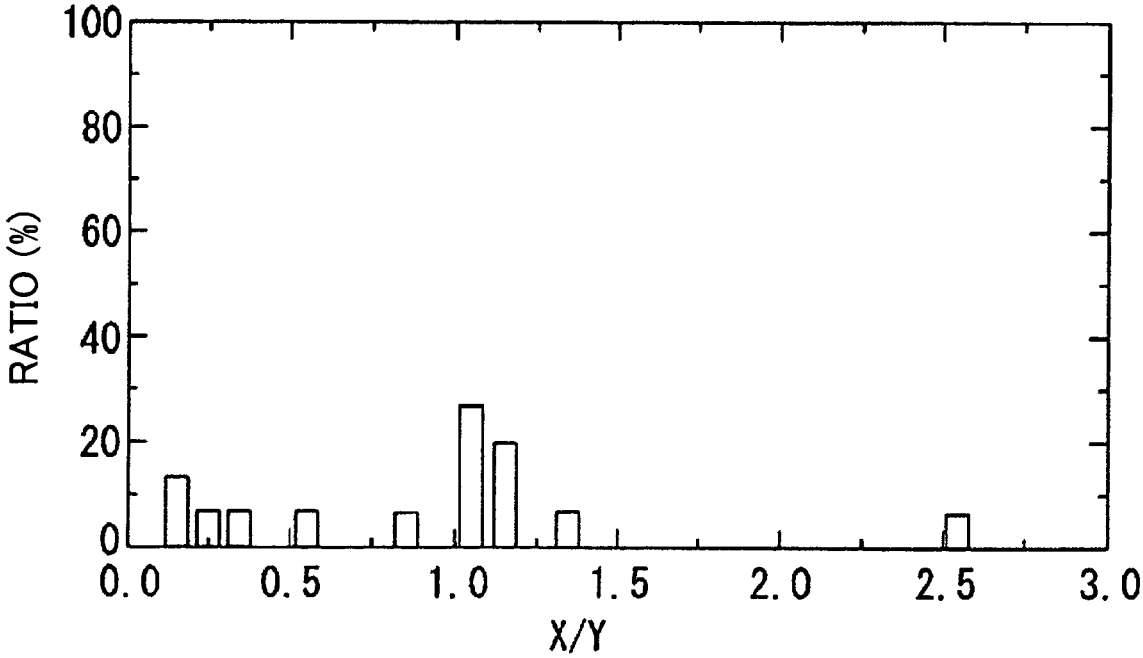
FIG. 24 is a graph showing the ratio X/Y to main phase grains that were measurement targets in Comparative example 6.

As shown in FIGS. 22, 23, and 24, the (X/Y)max values in Comparative examples 5 and 6 are large, and these are over 2.0. That is, the X/Y distribution is extremely wide in Comparative examples 5 and 6. Hence, although portions with a high Dy concentration and portions with a low Dy concentration exist in the main phase region except for an R rich phase, if the X/Y distribution is too wide, it results in a decrease in the coercive force (HcJ). Therefore, in the present invention, the values of (X/Y)min and (X/Y)max are determined in the following ranges: (X/Y)min=0.1 to 0.6; and (X/Y)max=1.0 to 1.6.

FIFTH EXAMPLE

Sintered magnets were produced in the same processes as those in the first example with the exceptions that the low R alloys and high R alloys shown in FIG. 25 were used, that the particle sizes of the pulverized powders were set as described below, and that the sintering temperature was set at 1,030° C. Regarding the obtained sintered magnets, the same measurement and observation as those in the first example were carried out. The chemical compositions of the obtained sintered bodies and the magnetic properties thereof are shown in FIG. 26. In Examples 9 and 10, the Tb amount contained in the high R alloy powders was 62 wt % with respect to the Tb amount contained in each sintered body. In addition, the AVE(X), Y, AVE(X)/Y, (X/Y)min, and (X/Y)max of each sintered magnet are shown in FIG. 27.

Example 9 =4.0 μm, Example 10 =4.2 μm,

Comparative example 7 =4.1 μm, and Comparative example 8 =4.0 μm

As shown in FIG. 26, it is found that a high coercive force (HcJ) of 24 kOe or more can be obtained by using Tb as a heavy rare earth element. In addition, as shown in FIG. 26, it is also found that the chemical compositions of the sintered magnets obtained in Examples 9 and 10 and Comparative examples 7 and 8 are almost same, but that the residual magnetic flux density (Br) in Comparative examples 7 and 8 is inferior to that in Examples 9 and 10.

As shown in FIGS. 27 and 28, in Examples 9 and 10 and Comparative examples 7 and 8, the ratio of coarse particles contained in a sintered body is low, and thus, the sintered body consists of good microstructures. However, in Comparative examples 7 and 8, the value of AVE(X)/Y exceeds 1.0 and the value of (X/Y)min exceeds 0.6. These facts result in a decrease in the residual magnetic flux density (Br).

SIXTH EXAMPLE

Sintered magnets were produced in the same processes as those in the first example with the exceptions that the low R alloys and high R alloys shown in FIG. 29 were used, that the particle sizes of the pulverized powders were set as described below, that the sintering temperature was set at 1,030° C., and that regarding Example 11 and Comparative example 9, the atmosphere was controlled at an oxygen concentration less than 100 ppm throughout processes, from a hydrogen treatment (recovery after a crushing process) to sintering (input into a sintering furnace) and the sintering temperature was set at 1,070° C.

Regarding the obtained sintered magnets, the same measurement and observation as those in the first example were carried out. The chemical compositions of the obtained sintered bodies and the magnetic properties thereof are shown in FIG. 30. In addition, the AVE(X), Y, AVE(X)/Y, (X/Y)min, and (X/Y)max of each sintered magnet are shown in FIG. 31

Example 11 =3.1 μm, Example 12 =3.0 μm,

Comparative example 9 =3.1 μm, and Comparative example 10 =3.0 μm

As shown in FIG. 30, it is found that when the amount of rare earth elements is low, the residual magnetic flux density (Br) becomes high and the coercive force (HcJ) becomes low, and that when the amount of rare earth elements is high, the residual magnetic flux density (Br) becomes low and the coercive force (HcJ) becomes high.

As shown in FIG. 30, the chemical compositions of the sintered magnets obtained in Examples 11 and Comparative example 9, and those obtained in Example 12 and Comparative example 10, are each almost same. However, it is found that the residual magnetic flux density (Br) in Comparative example 9 is inferior to that in Example 11, and that the residual magnetic flux density (Br) in Comparative example 10 is inferior to that in Example 12. As shown in FIG. 31, the value of AVE (X)/Y exceeds 1.0 and the value of (X/Y) min exceeds 0.6 in Comparative examples 9 and 10. These facts result in a decrease in the residual magnetic flux density (Br).

INDUSTRIAL APPLICABILITY

As stated above, the present invention provides an R-T-B ststem rare earth permanent magnet having both a high residual magnetic flux density and a high coercive force.

The invention claimed is:

1. An R-T-B rare earth permanent magnet, which comprises a sintered body comprising at least: main phase grains comprising $R_2T_{14}B$ compounds (wherein R represents one or more rare earth elements, providing that the term "rare earth element" include Y (yttrium), and T represents one or more transition metal elements essentially containing Fe, or Fe and Co); and a grain boundary phase having a higher amount of R than said main phase grains, which is characterized in that said sintered body satisfies the following formulas:

$$AVE(X)/Y=0.8 \text{ to } 1.0; \text{ and}$$

$$(X/Y)max/(X/Y)min=2.0 \text{ to } 13.0,$$

wherein X represents (the amount of heavy rare earth elements) (wt %)/(the amount of all the rare earth elements (wt %)) for a given number of said main phase grains in said sintered body;

Y represents (the amount of heavy rare earth elements(wt %))/(the amount of all the rare earth elements (wt %)) for said sintered body as a whole;

AVE(X) represents the mean value of X obtained for the given number of said main phase grains;

(X/Y)min represents the minimum value of (X/Y) obtained for the given number of said main phase grains; and (X/Y) max represents the maximum value of (X/Y) obtained for the given number of said main phase grains.

2. The R-T-B rare earth permanent magnet according to claim 1, characterized in that said sintered body satisfies the formulas:

$$(X/Y)min=0.1 \text{ to } 0.6; \text{ and } (X/Y)max=1.0 \text{ to } 1.6.$$

3. The R-T-B rare earth permanent magnet according to claim 1, characterized in that said sintered body satisfies the formula:

$$AVE(X)/Y=0.82 \text{ to } 0.98.$$

4. The R-T-B rare earth permanent magnet according to claim 1, characterized in that said sintered body satisfies the formula:

$$(X/Y)max/(X/Y)min=3.0 \text{ to } 10.0.$$

5. The R-T-B rare earth permanent magnet according to claim 1, characterized in that said sintered body satisfies the formulas:

$$(X/Y)min=0.1 \text{ to } 0.5; \text{ and } (X/Y)max=1.1 \text{ to } 1.5.$$

6. The R-T-B rare earth permanent magnet according to claim 1, characterized in that 85% or more of the total area occupied by said main phase grains is occupied by grains having a grain size of 15 μm or smaller.

7. The R-T-B rare earth permanent magnet according to claim 1, characterized in that 85% or more of the total area occupied by said main phase grains is occupied by grains having a grain size of 10 μm or smaller.

8. The R-T-B rare earth permanent magnet according to claim 1, characterized in that said magnet has a composition consisting essentially of 25 to 37 wt % of R, 0.5 to 1.5 wt % of B, 0.03 to 0.3 wt % of Al, 0.15 wt % or less of Cu (excluding 0), 2 wt % or less of Co (excluding 0), and the balance substantially being Fe.

9. The R-T-B rare earth permanent magnet according to claim 8, characterized in that said magnet comprises 0.1 to 8.0 wt % of heavy rare earth elements as R.

* * * * *

UNITED STATES PATENT AND TRADEMARK OFFICE

CERTIFICATE OF CORRECTION

PATENT NO. : 7,618,497 B2
APPLICATION NO. : 10/541964
DATED : November 17, 2009
INVENTOR(S) : Eiji Kato and Chikara Ishizaka It is certified that error appears in the above-identified patent and that said Letters Patent is hereby corrected as shown below:

Title Page, Item (22) PCT Filed: please change the PCT Filed date to Jun. 29, 2004

Signed and Sealed this

Sixteenth Day of February, 2010

David J. Kappos

David J. Kappos
*Director of the United States Patent and Trademark Office*